US005474880A

United States Patent [19]

Makuta

[11] Patent Number: 5,474,880

[45] Date of Patent: Dec. 12, 1995

[54] SILVER HALIDE COLOR PHOTOSENSITIVE MATERIAL

[75] Inventor: Toshiyuki Makuta, Kanagawa, Japan

[73] Assignee: Fuji Photo Film Co., Ltd., Kanagawa, Japan

[21] Appl. No.: 304,817

[22] Filed: Sep. 13, 1994

Related U.S. Application Data

[63] Continuation of Ser. No. 63,090, May 18, 1993, abandoned.

[30] Foreign Application Priority Data

May 21, 1992 [JP] Japan ..... 4-153058

[51] Int. Cl.[6] ..... G03C 1/46

[52] U.S. Cl. ..... 430/505; 430/546; 430/558

[58] Field of Search ..... 430/558, 384, 430/385, 546, 377, 505

[56] References Cited

U.S. PATENT DOCUMENTS

| | | | |
|---|---|---|---|
| 4,873,183 | 10/1989 | Tachibana et al. | 430/550 |
| 4,916,051 | 4/1990 | Tachibana et al. | 430/558 |
| 5,091,297 | 2/1992 | Fukunaga et al. | 430/538 |
| 5,164,289 | 11/1992 | Shimada et al. | 430/384 |
| 5,188,926 | 2/1993 | Schofield et al. | 430/377 |
| 5,200,303 | 4/1993 | Takahashi et al. | 430/377 |
| 5,215,871 | 6/1993 | Sato et al. | 430/384 |
| 5,256,526 | 10/1993 | Suzuki et al. | 430/384 |
| 5,270,153 | 12/1993 | Suzuki et al. | 430/384 |

FOREIGN PATENT DOCUMENTS

| | | |
|---|---|---|
| 0488248 | 6/1992 | European Pat. Off. . |
| 0491197 | 6/1992 | European Pat. Off. . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

Disclosed is a silver halide color photosensitive material having on a support at least a cyan color-generating silver halide emulsion layer in which oleophilic fine particles containing both a pyrroloazole type cyan coupler and a phenol or amide type high boiling organic solvent are dispersed, thereby ensuring excellent cyan-color generation performance, desirable spectral sensitivity characteristics and satisfactory color reproduction and making it feasible to reduce the change of the generated color from pure to muddy upon storage under a high temperature-high humidity condition.

19 Claims, No Drawings

SILVER HALIDE COLOR PHOTOSENSITIVE MATERIAL

This application is a continuation, of application Ser. No. 08/063,090, filed on May 18, 1993, now abandoned.

FIELD OF THE INVENTION

The present invention relates to a silver halide color photosensitive material and, more particularly, to a silver halide photosensitive material which has satisfactorily high color formability and excellent color reproducibility.

BACKGROUND OF THE INVENTION

In silver halide color photosensitive materials, phenol or naphthol type cyan couplers are commonly used for forming cyan color images. However, those couplers have undesirable absorption in the regions of green rays of light and blue rays of light, so that they have a severe problem that they are responsible for considerable drop in the reproducibilities of blue and green colors. Therefore, solving this problem has been strongly desired.

As a measure for solving such a problem, the 2,4-diphenylimidazole type cyan couplers disclosed in EP-A2-0249453 were proposed. Since the dyes formed from these cyan couplers are reduced in undesirable absorption present in the regions of green rays of light and blue rays of light, compared with the dyes formed from the above-cited cyan couplers of phenol and naphthol types, an improvement in color reproducibility is brought about by those couplers, to be sure, but the color reproducibility attained by those couplers is not wholly satisfactory. Such being the case, a further improvement is required of them. In addition, those couplers suffer from a serious problem that they exhibit low activity in the reaction with oxidized developing agents (namely, low coupling activity) and the dyes formed therefrom are considerably low in fastness to heat and light. Accordingly, those couplers cannot serve the purpose of practical use as they are.

Further, the pyrazoloazole type cyan couplers disclosed in U.S. Pat. No. 4,873,183, JP-A-64-552 (the term "JP-A" as used herein means an "unexamined published Japanese patent application"), JP-A-64-553, JP-A-64-554, JP-A-64-555, JP-A-64-556 and JP-A-64-557 can form dyes which are reduced in undesirable absorption present in green and blue regions, compared with conventional dyes, but they are still unsatisfactory in view of color reproducibility. In addition, they have a problem such that their color formabilities are markedly low.

Furthermore, EP-A1-0456226 discloses pyrroloazole type cyan couplers as cyan couplers capable of forming dyes excellent in hue. These couplers undergo an improvement over the above-cited couplers in view of color reproducibility, but the improvement is not yet very satisfactory. In addition, they have a drawback of causing serious color stain in unexposed areas, and their color formability is not on a very satisfactory level.

On the other hand, ensuring a high keeping quality in images is another matter of great importance to silver halide color photosensitive materials. The dyes formed from generally used phenol or naphthol type cyan couplers have a problem such that the colors thereof become muddy as a change to yellow is caused therein due to fading upon long-range storage under a high temperature and high humidity condition.

Under these circumstances, it has been desired tin the art to ensure satisfactory color reproducibility and high keeping quality in cyan color images formed in silver halide color photosensitive materials.

SUMMARY OF THE INVENTION

Therefore, a first object of the present invention is to provide a silver halide color photosensitive material which exhibits a high degree of color generation with respect to the cyan dye formed therein and has excellent spectral characteristics to provide satisfactory color reproducibility.

A second object of the present invention is to provide a silver halide color photosensitive material which forms a cyan dye capable of not only attaining the first object but also being reduced in deterioration of color clarity upon storage under a high temperature and high humidity condition and thereby ensuring excellent keeping quality to the cyan dye image.

The above-described objects of the present invention are attained with a silver halide color photosensitive material having on a support at least a cyan dye-forming coupler containing silver halide emulsion layer, a magenta dye-forming coupler containing silver halide emulsion layer and a yellow dye-forming coupler containing silver halide emulsion layer, wherein said cyan dye-forming coupler containing silver halide emulsion layer comprises a dispersion containing together at least one cyan dye-forming coupler represented by the following general formula (I) and at least one high boiling organic solvent represented by the following general formula (II) or (III):

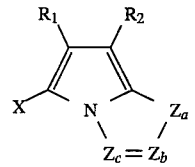

(Ia)

wherein Za represents —NH— or —CH($R_3$)—; Zb and Zc each represent —C($R_4$)= or —N=; $R_1$, $R_2$, and $R_3$ each represent an electron-withdrawing group having a Hammett's substituent constant $\sigma_P$ of at least 0.20, provided that the sum of the $\sigma_P$ of $R_1$ and $R_2$ is at least 0.65; $R_4$ represents a hydrogen atom or a substituent group, and when two $R_4$'s are present in the formula they may be the same or different; and X represents a hydrogen atom or a group capable of splitting off by the coupling reaction with the oxidation product of an aromatic primary amine color developing agent:

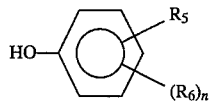

(II)

wherein $R_5$ and $R_6$ each represent an alkyl group, a cycloalkyl group, an alkoxy group or a halogen atom; n represents an integer of 0 to 4, and $R_6$'s may be the same or different when n is not smaller than 2; and further, $R_5$ and $R_6$ may combine with each other to complete a 5- or 6-membered ring:

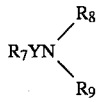

(III)

wherein $R_7$, $R_8$ and $R_9$ each represent a hydrogen atom, an alkyl group, a cycloalkyl group, an alkenyl group, a cycloalkenyl group, an alkinyl group, an aryl group, a heterocyclyl group, an alkoxy group, an aryloxy group or a heterocyclyloxy group, or $R_7$ represents —$NR_{10}R_{11}$ wherein $R_{10}$ and $R_{11}$ each represent a hydrogen atom, an alkyl group a cycloalkyl group, an alkenyl group, a cycloalkenyl group, an alkinyl group, an aryl group, a heterocyclyl group, an alkoxy group, an aryloxy group or a heterocyclyloxy group; and further, a ring-may be formed by combining $R_7$ with $R_8$, $R_8$ with $R_9$, or $R_9$ with $R_{10}$; and Y represents a carbonyl group, a sulfonyl group or —($R_{12}$) P(O)— wherein $R_{12}$ represents a hydrogen atom, an alkyl group, a cycloalkyl group, an alkenyl group, a cycloalkenyl group, an alkinyl group, an aryl group, a heterocyclyl group, an alkoxy group, an aryloxy group or a heterocyclyloxy group.

DETAILED DESCRIPTION OF THE INVENTION

The compounds of the present invention are described below in detail.

In general formula (Ia), Za represents —NH— or —CH($R_3$)—, and Zb and Zc each represent —C($R_4$)= or —N=.

Therefore, the present cyan couplers represented by general formula (Ia) specifically include those having the following general formulae (Ic) to (Ii):

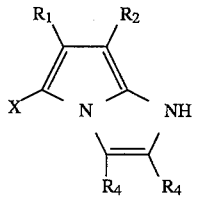

(Ic)

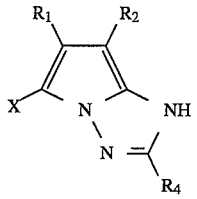

(Id)

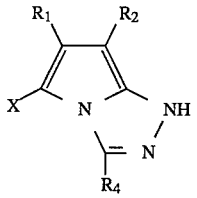

(Ie)

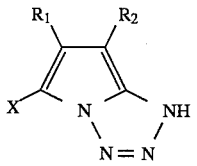

(If)

-continued

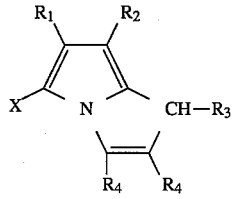

(Ig)

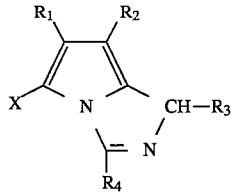

(Ih)

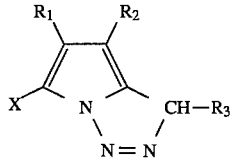

(Ii)

wherein $R_1$, $R_2$, $R_3$, $R_4$ and X have the same meanings as in general formula (Ia), respectively.

The cyan couplers which are preferable in the present invention are those represented by general formulae (Ic), (Id) and (Ie), especially those represented by general formula (Id).

In the cyan couplers of the present invention, all the substituents $R_1$, $R_2$ and $R_3$ are electron-withdrawing groups having a $\sigma_P$ value of at least 0.20, and the sum of the $\sigma_P$ values of $R_1$ and $R_2$ is at least 0.65. It is desirable for the sum of the $\sigma_P$ values of $R_1$ and $R_2$ to be at least 0.70, and the upper limit of said sum is not much exceeding 1.8.

$R_1$, $R_2$ and $R_3$ each are, as described above, an electron-withdrawing group having a Hammett's substituent constant $\sigma_P$ of at least 0.2. Each is preferably an electron-withdrawing group having a $\sigma_P$ value of at least 0.35, and more preferably an electron-withdrawing group having a $\sigma_P$ value of at least 0.60. With respect to the $\sigma_P$ value, the electron-withdrawing group has the upper limit of no greater than. 1.0. The Hammett' rule is the empirical rule proposed by L. P. Hammett in 1935 in order to treat quantitatively the effects of substituent groups upon the reaction or the equilibrium of benzene derivatives, and its validity is universally appreciated in these times. The substituent constants determined by the Hammett's rule are $\sigma_P$ and $\sigma_m$ values. The description of these values can be found in many general books. For instance, there are detailed descriptions in J. A. Dean, *Lange's Handbook of Chemistry*, 12th edition, McGraw-Hill (1979), and *Kagaku no Ryo-iki Zokan* (which means special numbers of "Domain of Chemistry"), number 122, pages 96–103. Nankodo, Tokyo (1979). In the present invention, $R_1$, $R_2$ and $R_3$ are specified definitely using a Hammett's substituent constant $\sigma_P$. Additionally, these substituents should not be construed as being limited to the substituents whose $\sigma_P$ values are already known through the references adopted in the foregoing books, but it is a matter of course that they include any substituents whose $\sigma_P$ values are within the range defined by the present invention when determined by the Hammett' rule even if they are not yet reported in literature.

Specific examples of electron-withdrawing groups having a $\sigma_P$ value of at least 0.20, which are represented by $R_1$, $R_2$ and $R_3$, include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenoalkyl group, a halogenoalkoxy group, a halogenoaryloxy group, a halogenoalkylamino group, a halogenoalkylthio group, an aryl group substituted with other electron-withdrawing groups having a $\sigma_P$ p value of at least 0.20, a heterocyclyl group, a halogen atom, an azo group and a selenocyanate group. These groups may further have substituents such as examples of the group represented by $R_4$ described hereinafter, provided that they can afford room for substituent groups.

More specifically describing $R_1$, $R_2$ and $R_3$, the electron-withdrawing groups whose $\sigma_P$ are at least 0.20 include an acyl group (e.g., acetyl, 3-phenylpropanoyl, benzoyl, 4-docecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, N-{3-(2,4-di-t-amylphenoxy)propyl}carbamoyl), an alkoxycarbonyl group(e.g., methoxycarbonyl, ethoxycarbonyl, iso-propyloxycarbonyl, tert-butyloxycarbonyl, iso-butyloxycarbonyl, butyloxycarbonyl, dodecyloxycarbonyl, octadecyloxycarbonyl, diethylcarbamoylethoxycarbonyl, perfluorohexylethoxycarbonyl, 2-decyl-hexyloxycarbonylmethoxycarbonyl), an aryloxycarbonyl group (e.g., phenoxycarbonyl, 2,5-di-amylphenoxycarbonyl), a cyano group, a nitro group, a dialkylphosphono group (e.g., dimethylphosphono), a diarylphosphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluenesulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a thiocyanate group, a thiocarbonyl group (e.g., methylthiocarbonyl, phenylthiocarbonyl), a halogenoalkyl group (e.g., trifluoromethyl, heptafluoropropyl), a halogenoalkoxy group (e.g., trifluoromethyloxy), a halogenoaryloxy group (e.g., pentafluorophenyloxy), a halogenoalkylamino group (e.g., N,N-di-(trifluoromethyl)amino), a halogenoalkylthio group (e.g., difluoromethylthio, 1,1,2,2-tetrafluoroethylthio), an aryl group substituted with other electron-withdrawing groups having a $\sigma_P$ value of at least 0.20 (e.g., 2,4-dinitrophenyl, 2,4,6-trichlorophenyl, pentachlorophenyl), a heterocyolyl group (e.g., 2-benzoxazolyl, 2-benzothiazolyl, 1-phenyl-2-benzimidazolyl, 5-chloro-1-tetrazolyl, 1-pyrrolyl ), a halogen atom (e,g., chlorine, bromine), an azo group (e.g., phenylazo) and selenocyanate group.

As for the representative electron-withdrawing groups, their $\sigma_P$ values are given below in parenthesis after the corresponding groups:

Cyano group (0.66), nitro group (0.78), trifluoromethyl group (0.54), acetyl group (0.50), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), pyrazolyl group (0.37), methanesulfonyloxy group (0.36), dimethoxyphosphoryl group (0.60), sulfamoyl group (0.57), and so on.

Substituent groups desirable for $R_1$, $R_2$, and $R_3$ include an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenoalkyl group, a halogenoalkyloxy group, a halogenoalkylthio group, a halogenoaryloxy group, a halogenoaryl group, an aryl group substituted with at least two nitro groups, and a heterocyclyl group. Of these groups, an acyl group, an alkoxycarbonyl group, an aryloxycarbonyl group, a nitro group, a cyano group, an arylsulfonyl group, a carbamoyl group and a halogenoalkyl group are preferred. More preferable ones are a cyano group, an alkoxycarbonyl group, an aryloxycarbonyl group and a halogenoalkyl group. In particular, the compounds represented by the following general formula (Ib) are employed to greater advantage:

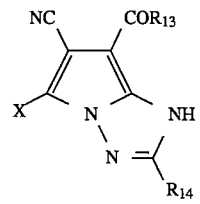

(Ib)

Examples of a group preferred as $R_{13}$ include a substituted or unsubstituted branched or straight-chain alkoxy group containing 2 to 24 carbon atoms, a substituted or unsubstituted cycloalkoxy group, a substituted or unsubstituted aryloxy group, a substituted or unsubstituted alkylamino group, an anilino group and a heterocyclylamino group. Much preferably, examples thereof are an unsubstituted branched alkoxy group containing 4 to 18 carbon atoms, a cycloalkoxy group, an alkoxy group substituted with one or more of an electron-withdrawing group such as a fluorine atom, an alkoxycarbonyl group, an acyl group, a nitro group, a cyano group, a sulfonyl group, etc., and a substituted or unsubstituted aryloxy group. In particular, a branched alkoxy group, a fluorine-substituted alkoxy group and an alkyl- or halogen-substituted aryloxy groups are favored over others.

$R_{14}$ represents a hydrogen atom or a substituent group (including an atom).

Specific examples of the substituent group represented by $R_4$ in general formula (Ia) and $R_{14}$, in general formula (Ib) include a halogen atom, an aliphatic group, an aryl group, a heterocyclyl group, an alkoxy group, an aryloxy group, a heterocyclyloxy group, an alkyl-, aryl- or heterocyclylthio group, an acyloxy group, a carbamoyloxy group, a silyloxy group, a Sulfonyloxy group, an acylamino group, an alkylamino group, an arylamino group, an ureido group, a sulfamoylamino group, an alkenyloxy group, a formyl group, an alkyl-, aryl- or heterocyclylacyl group, an alkyl-, aryl- or heterocyclylsulfonyl group, an alkyl-, aryl- or heterocyclylsulfinyl group, an alkyl-, aryl- or heterocyclyloxycarbonyl group, an alkyl-, aryl- or heterocyclyloxycarbonylamino group, a sulfonamido group, a carbamoyl group, a sulfamoyl group, a phosphonyl group, a sulfamido group, an imido group, an azolyl group, a hydroxy group, a cyano group, a carboxyl group, a nitro group, a sulfo group, and an unsubstituted amino group. The alkyl, aryl or heterocyclyl moieties contained in the above-cited groups may further be substituted with group(s) as instanced in the description of $R_4$ ($R_{14}$).

More specifically, $R_4$ ($R_{14}$) represents a hydrogen atom, a halogen atom (e.g., chlorine, bromine), an aliphatic group (including straight-chain or branched alkyl, aralkyl, alkenyl, alkinyl, cycloalkyl and cycloalkenyl groups which each contain 1 to 36 carbon atoms, such as methyl, ethyl, propyl, isopropyl, t-butyl, tridecyl, 2-methanesulfonylethyl, 3-(3-pentadecylphenoxy)propyl, 3-{4- {2-[4-(4-hydroxyphenylsulfonyl)phenoxy]dodecanamido} phenyl}propyl, 2-ethoxytridecyl, trifluoromethyl, cyclopentyl, 3-(2,4-di-t-amylphenoxy)propyl), an aryl group (preferably containing 6 to 36 carbon atoms, e.g., phenyl, naphthyl, 4-hexadecoxyphenyl, 4-t-butylphenyl, 2,4-di-t-amylphenyl, 4-tetradecanamidophenyl, 3-( 2,4-di-tert-amylphenoxyacetamido)phenyl), a heterocyclyl group (e.g., 3-pyridyl, 2-furyl, 2-thienyl, 2-pyridyl, 2-pyrimidinyl, 2-benzothiazolyl), an alkoxy group (e.g., methoxy, ethoxy, 2- 2-dodecyloxyethoxy, 2-methanesulfonylethoxy), an aryloxy group (e.g., phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, 3-methoxycarbamoylphenoxy), a heterocyclyloxy group (e.g., 2-benzimidazolyloxy, 1-phenyltetrazole-5-oxy, 2-tetrahydropyranyloxy), an alkyl-, aryl- or heterocyclylthio group (e.g.,methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenylthio, 4-tetradecanamidophen-ylthio, 2-benzothiazolylthio, 2,4-di-phenoxy- 1,3,4-triazole-6-thio, 2-pyridylthio), an acyloxy group (e.g., acetoxy, hexadecanoyloxy), a carbamoyloxy group (e.g., N-ethylcarbamoyloxy, N-phenylcarbamoyl-oxy), a silyloxy group (e.g., trimethylsilyloxy, dibutylmethylsilyloxy), a sulfonyloxy group (e.g., dodecylsulfonyloxy), an acyl-amino group (e.g., acetamido, benzamido, tetradecanamido, 2-(2,4-di-tert-amylphenoxy)acetamido, 2-[4-(4-hydroxyphenylsulfonyl)phenoxy)]decanamido, isopentadecanamido, 2-(2,4-di-tert-amylphenoxy)-butanamido, 4-(3-t-butyl-4-hydroxyphenoxy)butanamido), an alkylamino group (e.g., methylamino, butylamino, dodecylamino, dimethylamino, diethylamino, methylbutylamino), an arylamino group (e.g., phenylamino, 2-chloroanilino, 2-chloro-5-tetradecanamidoani-lino, N-acetylanilino, 2-chloro-5-[α-(2-tert-butyl-4-hydroxy-phenoxy)dodecanamido]anilino, 2-chloro-5-dodecyloxycarbonylanilino), an ureido group (e.g., methylureido, phenylureido, N ,N-dibutylureido, dimethylureido), a sulfamoylamino group (e.g., N,N-dipropylsulfamo-ylamino, N-methyl-N-decylsulfamoylamino), an alkenyloxy group (e.g., 2-propenyloxy), a formyl group, an alkyl, aryl or heterocyclic acyl group (e.g., acetyl, benzoyl, 2,4-di-tert-amylphenylacetyl, 3-phenylpropanoyl, 4-dodecyloxybenzoyl), an alkyl, aryl or heterocyclic sulfonyl group (e.g., methanesulfonyl, octanesulfonyl, benzenesulfonyl, toluenesulfonyl), a sulfinyl group (e.g., octanesulfinyl, dodecylsulfinyl, phenylsulfinyl, 3-pentadecylphenylsulfinyl, 3-phenoxypropylsulfinyl), an alkyl-, aryl- or heterocyclyloxycarbonyl group (e.g., methoxycarbonyl, butoxycarbonyl, dodecyloxycarbonyl, octadecyloxycarbonyl, phenyloxycarbonyl, 2-pentadecyloxycarbonyl), an alkyl-, aryl- or heterocyclyloxycarbonylamino group (e.g., methoxycarbonylamino, tetradecyloxycarbonylamino, phenoxycarbonylamino, 2,4-di-tert-butylphenoxycarbonyl-amino), a sulfonamido group (e.g., methanesulfonamido, hexadecanesulfonamido, benzenesulfonamido, p-toluenesulfonamido, octadecanesulfonamido, 2-methoxy-5-tert-butylbenzenesulfonamido), a carbamoyl group (e.g., N-ethylcarbamoyl, N,N-dibutylcarbamoyl, N-(2-dodecyloxyethyl) carbamoyl, N-methyl-N-dodecyl-carbamoyl, N-[3-(2,4-di-tert-amylphenoxy)propyl]carbamoyl), a sulfamoyl group (e.g., N-ethylsulfamoyl, N,N-dipropylsulfamoyl, N-(2-dodecyloxyethyl)sulfamoyl, N-ethyl-N-dodlecylsulfamoyl, N,N-diethylsulfamoyl), a phosphonyl group (e.g., phenoxyphosphonyl, octyloxyphosphonyl, phenylphosphonyl), a sulfamido group (e.g., dipropylsulfamoylamino), an imido group (e.g., N-succinimdo, hydantoinyl, N-phthalimido, 3-octadecenylsuccinimido), an azolyl group (e.g., imidazolyl, pyrazolyl, 3-chloro-pyrazole-1-yl, triazolyl), a hydroxy group, a cyano group, a carboxyl group, a nitro group, a sulfo group, an unsubstituted amino group or so-on.

Groups preferred as $R_4$ ($R_{14}$) are an alkyl group, an aryl group, a heterocyclyl group, a cyano group, a nitro group, an acylamino group, an arylamino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocylyloxy group, an acyloxy group, a carba-moyloxy group, an aryloxycarbonylamino group, an imido group, a heterocyclylthio group, a sulfinyl group, a phosphonyl group, an acyl group and an azolyl group.

Of the above-cited groups, an alkyl group and an aryl group are much preferable. Further, it is desirable for these groups to be substituted with at least one alkoxy, sulfonyl, sulfamoyl, carbamoyl, acylamido or sulfonamido group. An especially preferred group as $R_4$ ($R_{14}$) is an alkyl or aryl group containing at least one acylamido or sulfonamido group as substituent.

X in general formula (Ia) and general formula (Ib) represents a hydrogen atom or a group capable of splitting off when the coupler reacts with the oxidation product of an aromatic primary amine color developing agent (the group is abbreviated as "a splitting-off group" hereinafter). When X represents a splitting-off group, the splitting-off group includes a halogen atom; an aromatic azo group; an alkyl, aryl, heterocyclyl, alkyl-or arylsulfonyl, arylsulfinyl, alkyl- or arylcarbonyl, or alkyl-, aryl- or heterocyclylcarbonyl group which is attached to the coupling site via an oxygen, nitrogen, sulfur or carbon atom; and a heterocyclyl group which is attached to the coupling site via the nitrogen atom thereof. Specifically, a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclylthio group, a carbamoylamino group, an arylsulfinyl group, an arylsulfonyl group, a 5- or 6-membered nitrogen-containing heterocyclyl group, an imido group and an arylazo group are examples of the splitting-off group. The alkyl, aryl or heterocyclyl moiety contained in the splitting-off group may further be substituted with group(s) included in specific examples of $R_4$. When such a moiety has two or more substituents, the substituents may be the same or different and may further have a substituent as instanced in the description of $R_4$.

More specifically, the splitting-off group includes a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyrylamino), an alkyl- or arylsulfonamido group (e.g., methanesulfonamido, trifluoromethanesulfonylamido, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an alkyl-, aryl- or heterocyclylthio group (e.g., ethylthio, 2-carboxyethylthio, dodecylthio, 1-carboxydodecylthio, phenylthio, 2-butoxy-5-tert-octylphenylthio, tetrazolylthio), an arylsulfonyl group (e.g., 2-butoxy-5-tert-octylphenylsulfonyl), an arylsulfinyl group (e.g., 2-butoxy-5-tert-octylphenylsulfinyl), a carbamoylamino group (e.g., N-methylcarbamoylamino, N-phenylcarbamoylamino), a 5-or 6-membered nitrogen-containing heterocyclyl group (e.g., imidazolyl, pyrazolyl, triazolyl, tetrazolyl, 1,2-dihydro-2-oxo-1-pyridyl), an imido group (e.g., succinimido, hydantoinyl), an arylazo group (e.g., phenylazo, 4-methoxyphenylazo) and so on. Of course, the groups cited above may further be substituted with substituent(s) instanced in the description of $R_4$. In addition, splitting-off groups of the type which are attached to the coupling site via a carbon atom include those which constitute bis-type couplers formed by condensing four-equivalent couplers through aldehydes or ketones. The splitting-off groups used in the present invention may contain a photographically useful group, such as a development inhibitor residue, a development accelerator residue or so on.

It is preferable for X to be a halogen atom, an alkoxy group, an aryloxy group, an alkyl- or arylthio group, an arylsulfonyl group, an arylsulfinyl group or a 5- or 6-membered nitrogen-containing heterocyclyl group which is attached to the coupling active site via the nitrogen atom thereof. Of these groups, an arylthio group is much preferable.

The cyan coupler represented by general formula (Ia) may be a dimer or higher polymeric compound formed by containing one or more residues of the cyan coupler of general formula (Ia) in the substituent group $R_1$, $R_2$, $R_3$, $R_4$, or X, or may be a homopolymer or copolymer formed by containing a high molecular chain in the substituent group $R_1$, $R_2$, $R_3$, $R_4$ or X. The expression "a homopolymer or copolymer formed by containing a high-molecular chain" as used herein is intended to include, as typical examples, polymers consisting of or comprising addition-polymerizable ethylenic unsaturated compounds which each contains a residue of the cyan coupler represented by general formula (Ia). All the cyan color-forming repeating units present in the polymer may not be the same, and the copolymerizing component may be constituted of the same or different ethylenic monomers which do not form any color because they cannot couple with the oxidation product of an aromatic primary amine developer, such as acrylic acid esters, methacrylic acid esters and maleic acid esters.

Specific examples of the cyan coupler of the present invention are illustrated below. However, the invention should not be construed as being limited to these examples.

C-1

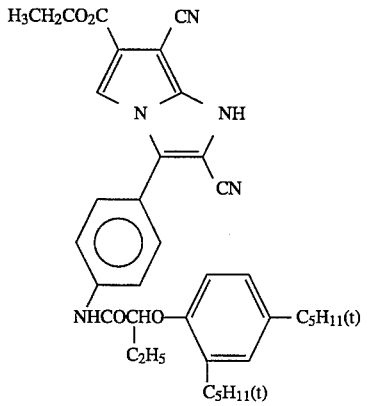

C-2

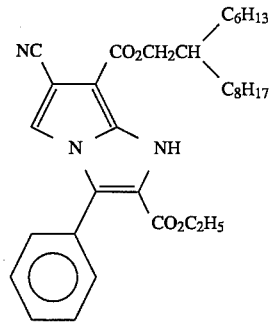

-continued
C-3
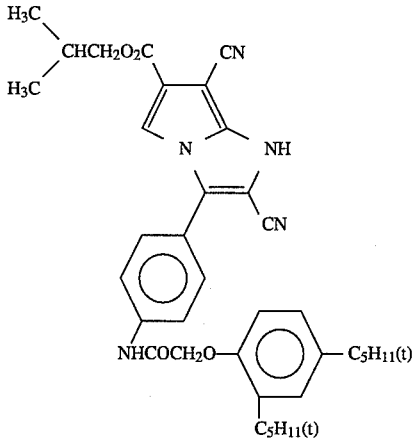
C-4
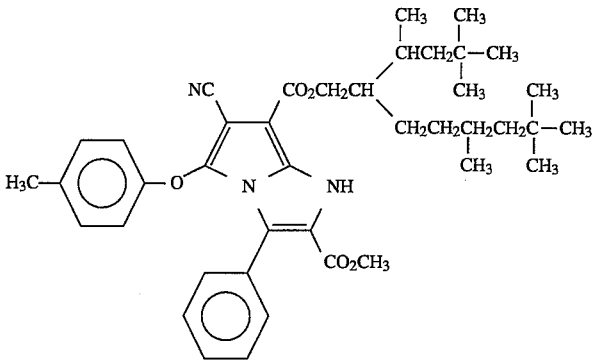
C-5
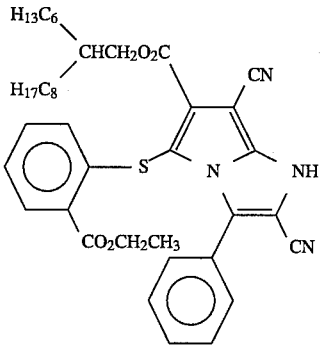
C-6
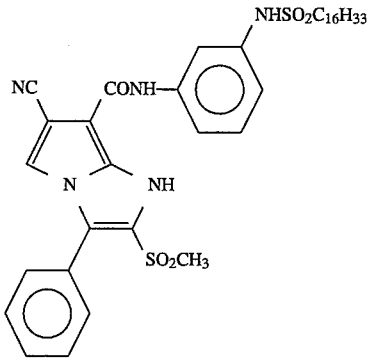

-continued
C-7
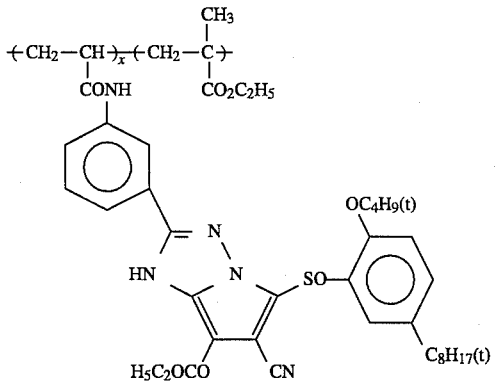
X:Y = 50:50 (by mole)

| No. | $R_1$ | $R_2$ | $R_4$ | X |
|---|---|---|---|---|
| | | 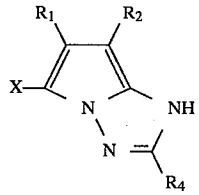 | | |
| C-8 | $CO_2CH_3$ | CN | 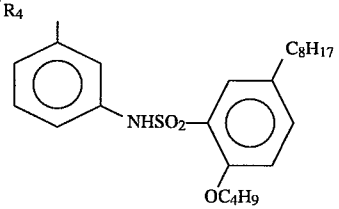 | H |
| C-9 | CN | 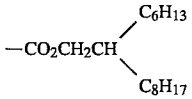 | 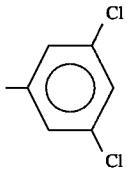 | H |
| C-10 | CN | 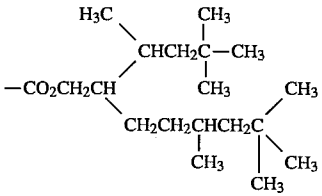 | 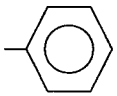 | H |
| C-11 | CN | 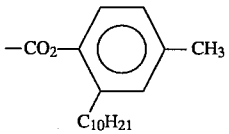 | 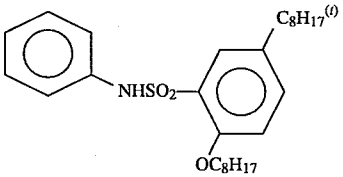 | H |

-continued
| No. | $R_1$ | $R_2$ | $R_4$ | X |
|---|---|---|---|---|
| C-12 | CN | 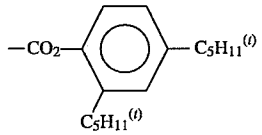 | 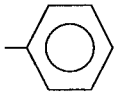 | H |
| C-13 | CN | 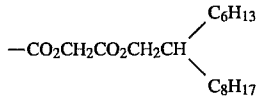 | 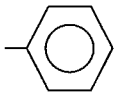 | H |
| C-14 | CN | $-CO_2CH_2CH_2(CF_2)_6F$ | 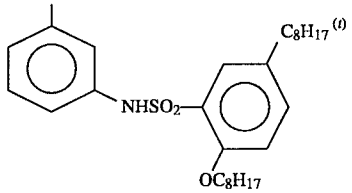 | H |
| C-15 | CN | 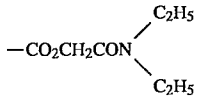 | 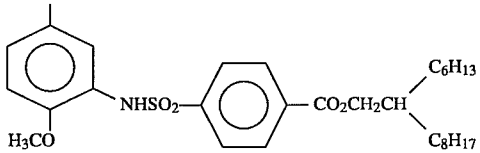 | 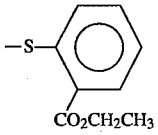 |
| C-16 | CN | $-CO_2CH_2CH_2(CF_2)_6F$ | 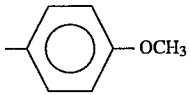 | 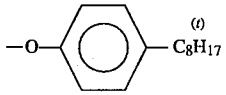 |
| C-17 | CN | 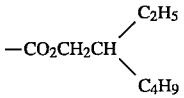 | 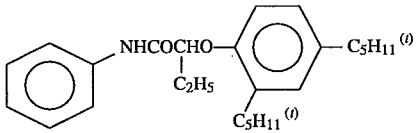 | 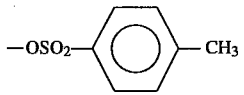 |

-continued
| No. | $R_1$ | $R_2$ | $R_4$ | X |
|---|---|---|---|---|
| C-18 | CN | 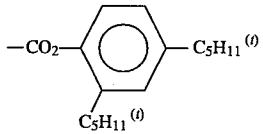 | 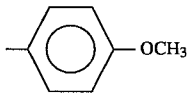 | 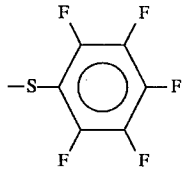 |
| C-19 | CN | 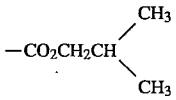 | 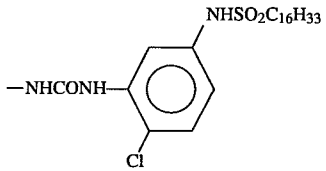 | 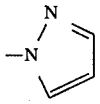 |
| C-20 | CN | $-CO_2CH_2(CF_2)_4H$ | 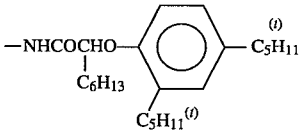 | 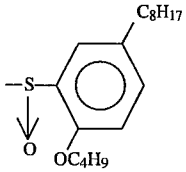 |
| C-21 | CN | 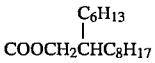 | 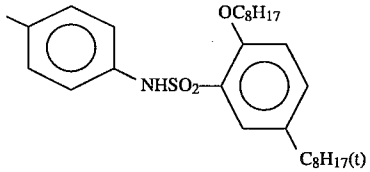 | H |
| C-22 | CN | CN | 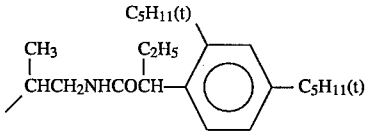 | H |

-continued
| No. | $R_1$ | $R_2$ | $R_4$ | X |
|---|---|---|---|---|
| C-23 | $CH_2C_2H_5$ | CN | 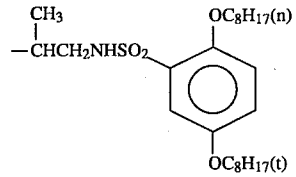 | H |
| C-24 | 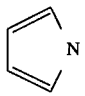 | CN | 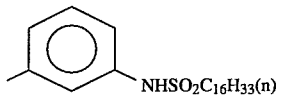 | Cl |
| C-25 | $CO_2CH_2H_5$ | CN | 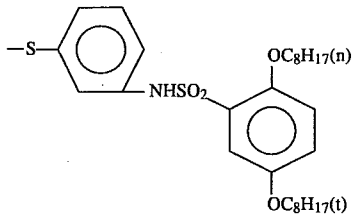 | H |
| C-26 | CN | CN | 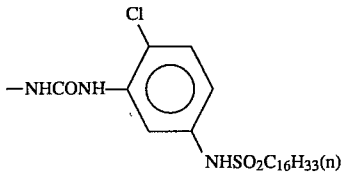 | Cl |
| C-27 | $CO_2C_2H_3$ | CN | 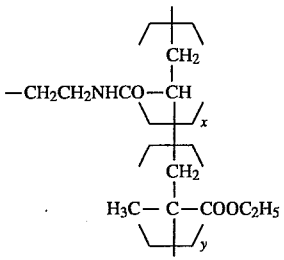 X:Y = 50:50 | Cl |

-continued
| No. | $R_1$ | $R_2$ | $R_4$ | X |
|---|---|---|---|---|
| C-28 | CN | $-CO_2CH_2CH(C_8H_{17})(C_6H_{13})$ | 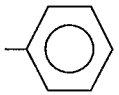 | H |
| C-29 | 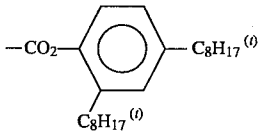 | CN | $-C(CH_3)_3$ | 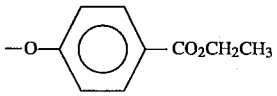 |
| C-30 | $-CO_2CH_2C_6F_{13}$ | CN | 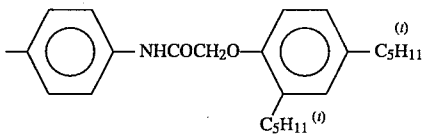 | Cl |
| C-31 | 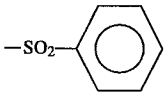 | 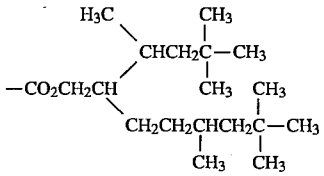 | $CH_3$ | $-OCOCH_3$ |
| C-32 | CN | $-CO_2CH_2CO_2CH_3$ | 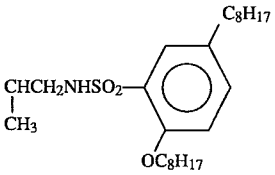 | 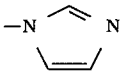 |
| C-33 | CN | 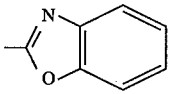 | 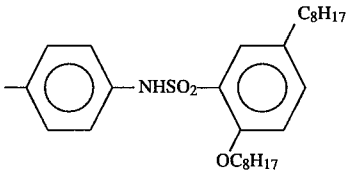 | 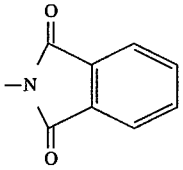 |

-continued
| No. | $R_1$ | $R_2$ | $R_4$ | X |
|---|---|---|---|---|
| C-34 | CN | $CF_3$ | 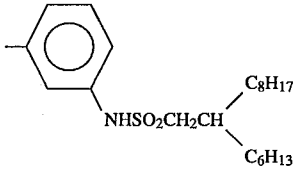 | Cl |
| C-35 | 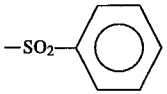 | $CF_3$ | 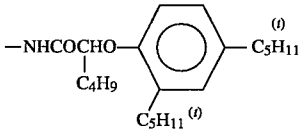 | F |
| C-36 | CN | 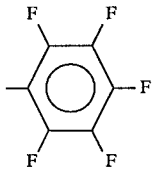 | 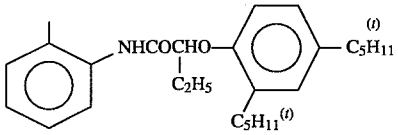 | 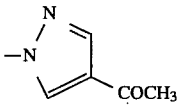 |
| C-37 | 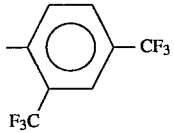 | $-SO_2Ph$ | 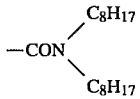 | 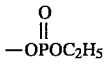 |
| C-38 | CN | 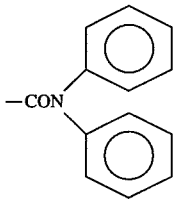 | 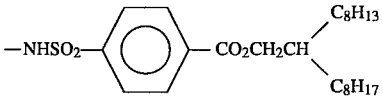 | 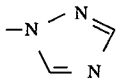 |
| C-39 | CN | 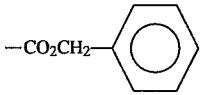 | 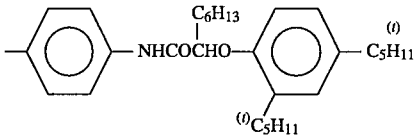 | H |

-continued
| No. | $R_1$ | $R_2$ | $R_4$ | X |
|---|---|---|---|---|
| C-40 | CN | 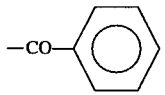 | 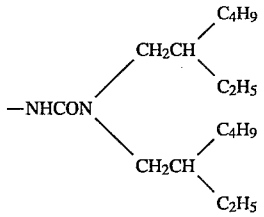 | $-OSO_2CH_3$ |
| C-41 | CN | $COC_4H_9(n)$ | 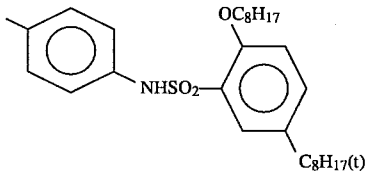 | H |
| C-42 | CN | $CON(C_2H_5)_2$ | 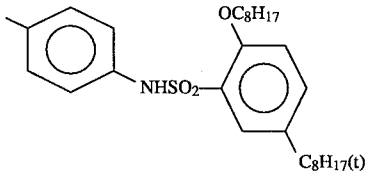 | H |
| C-43 | CN | $CO_2C_4H_9$ | 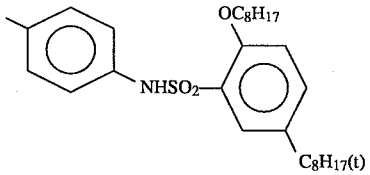 | H |
| C-44 | CN | $CO_2CH_2CO_2C_4H_9(n)$ | 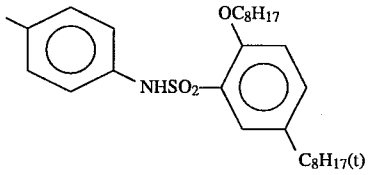 | H |

-continued
| No. | $R_1$ | $R_2$ | $R_4$ | X |
|---|---|---|---|---|
| C-45 | CN | 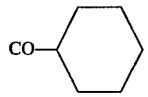 | 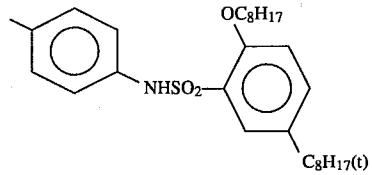 | H |
| | | 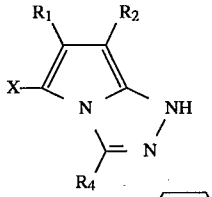 | | |
| C-46 | $-CO_2C_2H_5$ | CN | 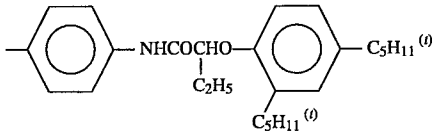 | Cl |
| C-47 | CN | 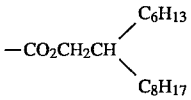 | 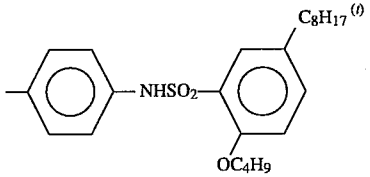 | H |
| C-48 | CN | $-CO_2CH_2CH_2(CF_2)_6F$ | 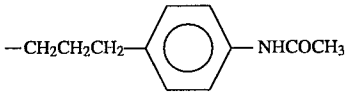 | 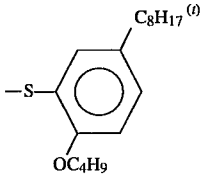 |
| C-49 | CN | 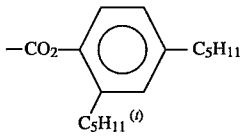 | 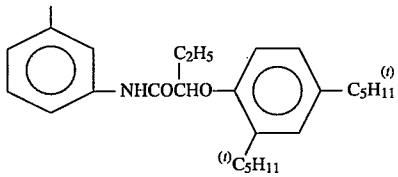 | 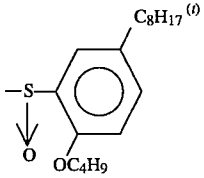 |

-continued
| No. | $R_1$ | $R_2$ | $R_4$ | X |
|---|---|---|---|---|
| C-50 | CN | 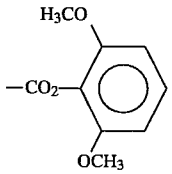 | 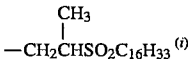 | 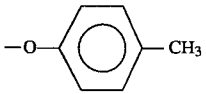 |
| C-51 | CN | 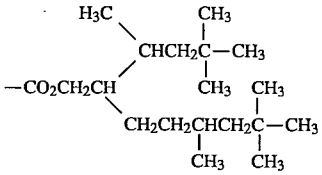 | 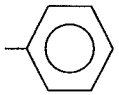 | H |
| C-52 | CN | 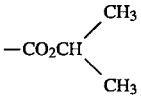 | 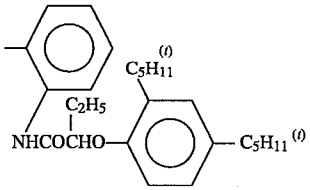 | Cl |
| C-53 | CN | 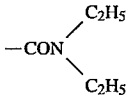 | 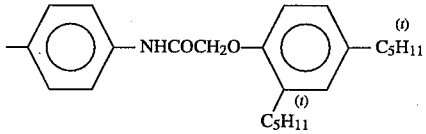 | $-OSO_2CH_3$ |
| C-54 | $SO_2CH_3$ | 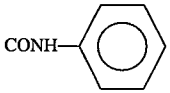 | 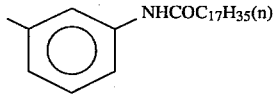 | 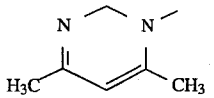 |
| C-55 | $NO_2$ | $CF_3$ | 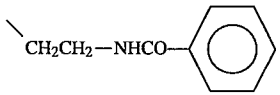 | 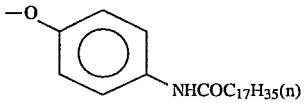 |

-continued
| No. | $R_1$ | $R_2$ | $R_4$ | X |
|---|---|---|---|---|
| C-56 | 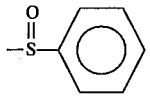 | $CF_3$ | $C_{17}H_{35}(n)$ | Cl |
| C-57 | $CO_2C_2H_5$ | $CO_2C_2H_5$ | 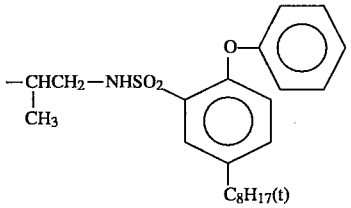 | Cl |
| C-58 | CN | CN | 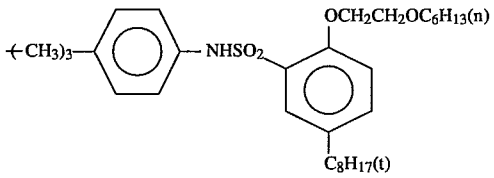 | Cl |

C-59

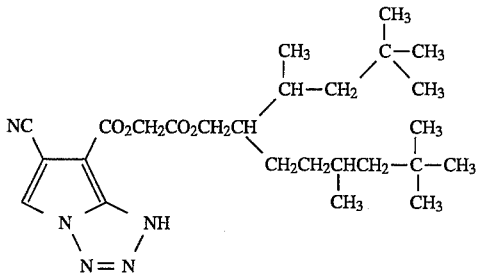

C-60

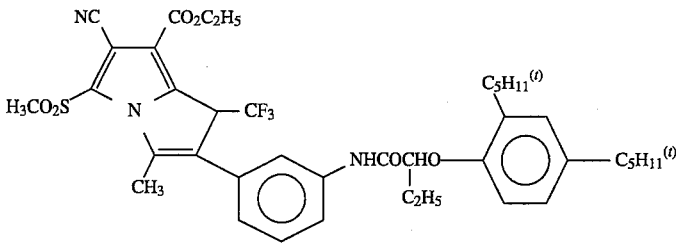

C-61

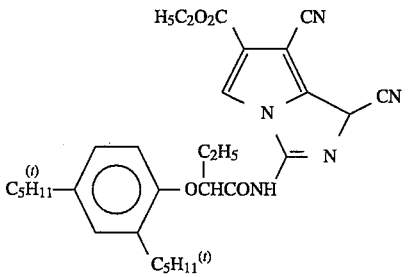

C-62

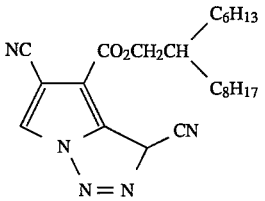

C-63

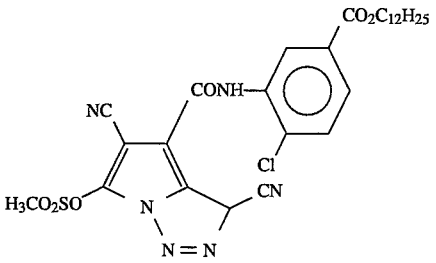

The couplers of the present invention and the intermediates thereof can be synthesized by known methods. For instance, the synthesis methods described in *J. Am. Chem. Soc.*, volume 80, page 5332 (1958), *J. Ame. Chem.*, volume 81. page 2452 (1959), *J. Am. Chem. Soc.*, volume 112, page 2465 (1990), Org. Synth., page 1270 (1941), *J. Chem. Soc.*, page 5149 (1962), *Heterocyclic.*, volume 27, page 2301 (1988), *Rec. Tray. Chim.*, volume 80, page 1075 (1961), and references cited therein, or methods analogous thereto can be used.

A typical example of the syntheses is illustrated below.

Synthesis Example 1

Synthesis of Coupler (C-9):

Coupler (C-9) is synthesized in accordance with the following reaction scheme;

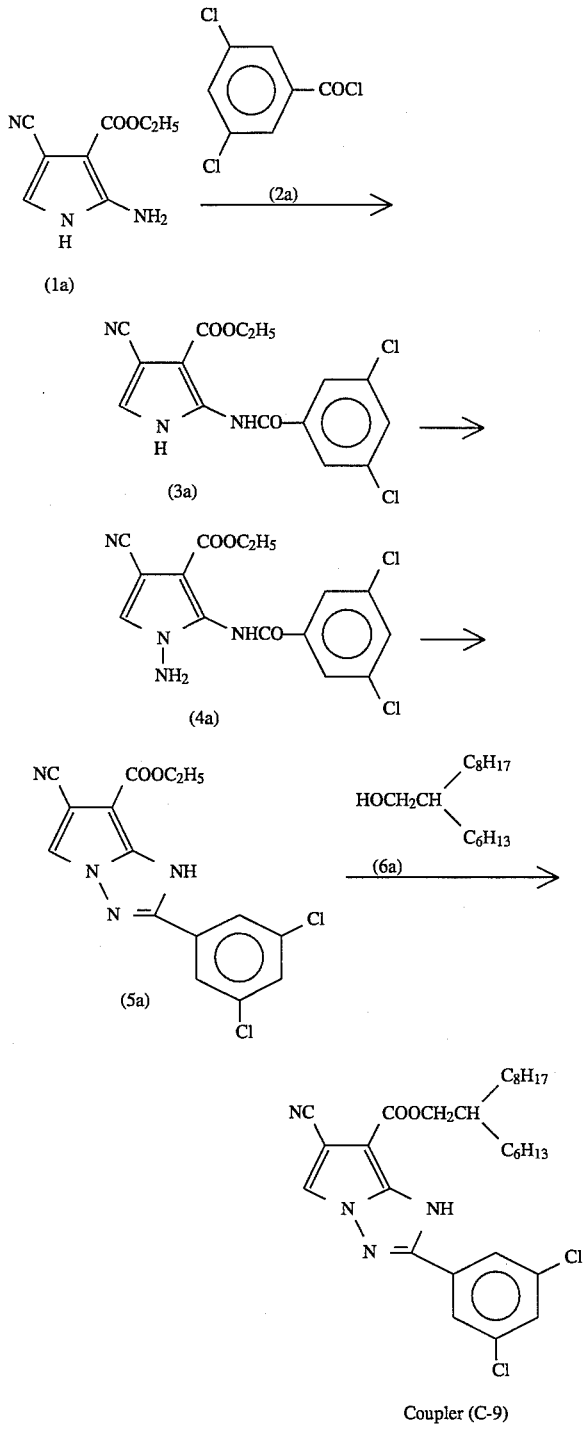

Coupler (C-9)

To a solution containing 2-amino-4-cyano-3-methoxycarbonylpyrrole (1a) (66.0 g, 0.4 mol) in dimelthylacetamide (300 ml), 3,5-dichlorobenzoyl chloride (2a) (83.2 g, 0.4 mol) is added, and stirred for 30 minutes. The reaction mixture is admixed with water, and the product is extracted in two steps with ethyl acetate. The organic layers are collected, washed successively with water and saturated brine, and dried over anhydrous sodium sulfate. Therefrom, the solvent is distilled away under reduced pressure, and the residue is recrystallized from acetonitrile (300 ml). Thus, the compound (3a) (113 g, 84% yield) is obtained.

The compound (3a) (101.1 g, 0.3 mol) is dissolved in dimethylformamide (200 ml), and admixed thoroughly with potassium hydroxide powder (252 g, 4.5 mol) at room temperature with stirring. To the mixture cooled with flowing water, hydroxylamine-o-sulfonic acid (237 g, 2.1 mol) is added little by little with care to avoid a sharp increase in the temperature. After the addition, the resulting mixture is stirred for 30 minutes. The reaction mixture is neutralized by dropping thereinto a 0.1N aqueous solution of hydrochloric acid as the pH thereof is checked with pH test paper. Therefrom, the reaction product is extracted in three steps with ethyl acetate. The organic layer obtained is washed successively with water and saturated brine, and dried over anhydrous sodium sulfate. The solvent is distilled away under reduced pressure, and the residue is purified by column chromatography (developing solvent: hexane/ethyl acetate=2/1). Thus, the compound (4a) (9.50 g, 9% yield) is obtained.

To a solution containing the compound (4a) (7.04 g, 20 mmol) in acetonitrile (30 ml) are added carbon tetrachloride (9 ml) and triphenylphosphine (5.76 g, 22 mmol) in succession at room temperature. The resulting solution is heated for 8 hours under reflux. After cooling, the reaction product is extracted in three steps with ethyl acetate. The organic layer obtained is washed successively with water and saturated brine, and dried over anhydrous sodium sulfate. The solvent is distilled away under reduced pressure, and the residue is purified by silica gel column chromatography (developing solvent: hexane/ethyl acetate=4/1). Thus, the compound (5a) (1.13 g, 17 % yield) is obtained.

The compound (5a) (1.8 g) and the compound (6a) (12.4 g) are dissolved in sulforan (2.0 ml), and thereto is added titanium isopropoxide (1.5 g). The reaction is run for 1.5 hours as the temperature of the reaction system is kept at 110° C. Then, the reaction mixture is admixed with ethyl acetate, and washed with water. After the ethyl acetate layer is dried, the solvent is distilled away and the residue is purified by column chromatography. Thus, 1.6 g of the intended compound, Coupler (C-9), is obtained. m.pt. 97°–98° C.

The present cyan couplers represented by general formula (Ia) are used in a silver halide emulsion layer at a coverage ranging preferably from 0.05 to 2.0 millimole/$m^2$, much preferably from 0.1 to 1.0 millimole/$m^2$. In other words, they are used in a silver halide emulsion layer in an amount ranging preferably from 0.01 to 1 mole, much preferably from 0.02 to 0.4 mole, per mole of silver.

The high boiling organic solvents represented by general formula (II) and (III) respectively are described below in detail.

The present high boiling organic solvents represented by general formula (II ) and (III ) may be in a liquid state at ordinary temperature (the boiling points of which are preferably not lower than 170° C.), or may be in a solid, amorphous or crystalline state at ordinary temperature (the melting points of which are preferably not higher than 100° C.).

Further, it is desirable that the present high boiling organic solvents contain such a group as to impart diffusion resistance to their individual molecules.

Making detailed description of general formula-(II), alkyl groups represented by $R_5$ and $R_6$ are preferably those containing 1 to 20 carbon atoms, specifically substituted or unsubstituted straight-chain or branched alkyl groups, such as methyl, ethyl, propyl, butyl, amyl, hexyl, octyl, decyl, dodecyl, hexadecyl, octadecyl, 2-(p-hydroxyphenyl)propane-2-yl, 8-hexadecenyl, etc.; cycloalkyl groups represented thereby include substituted and unsubstituted ones, such as cyclopentyl, cyclohexyl and so on; and alkoxy groups represented thereby include substituted or unsubstituted, straight-chain or branched alkoxy groups, such as methoxy, ethoxy, propoxy, butoxy, octyloxy, dodecyloxy, octadodecyloxy, methoxyethyloxy, ethoxyethyloxy, butoxyethyloxy, phenetyloxy, etc., and cyclic alkoxy groups such as cyclopentaoxy, cyclohexaoxy, etc. As for the halogen atoms represented by $R_5$ and $R_6$, it is preferable for them to be a chlorine atom.

Specific examples of the present high boiling organic solvent of phenol type are illustrated below. However, the invention should not be construed as being limited to these examples.

P-1

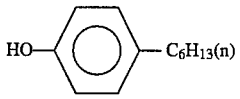

P-2

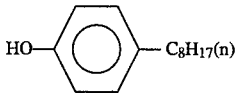

P-3

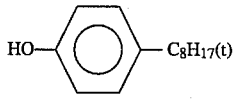

P-4

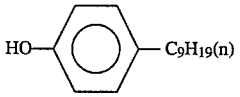

P-5

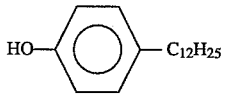

P-6

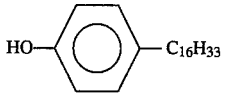

P-7

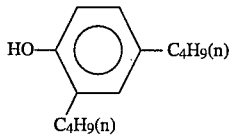

P-8

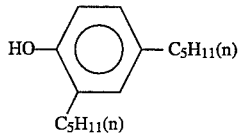

P-9

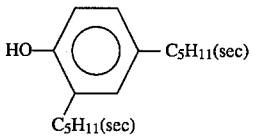

P-10

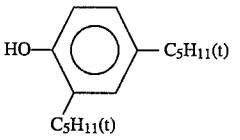

-continued

P-11

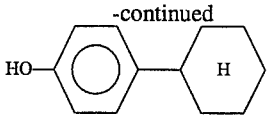

P-12

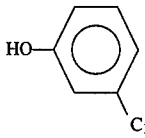

P-13

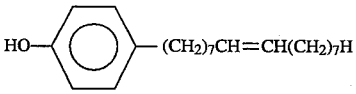

P-14

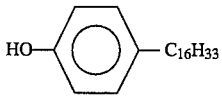

P-15

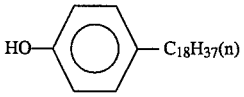

P-16

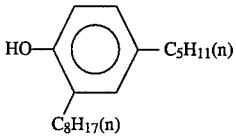

P-17

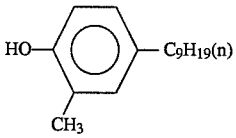

P-18

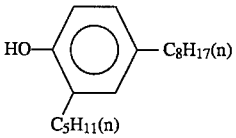

P-19

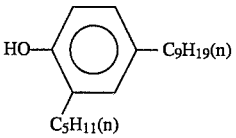

P-20

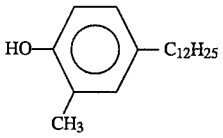

P-21

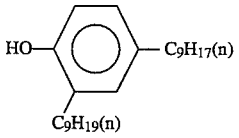

-continued
P-22
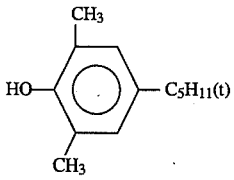
P-23
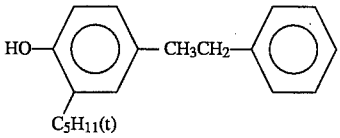
P-24
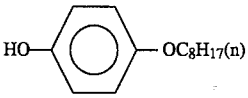
P-25
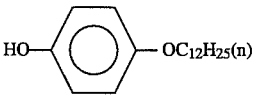
P-26
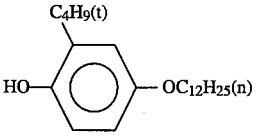
P-27
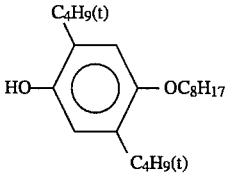
P-28
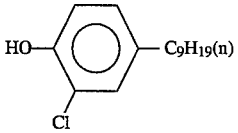
P-29
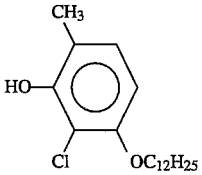
P-30
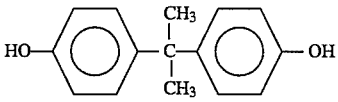
P-31
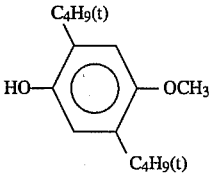
-continued
P-32
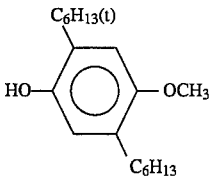
P-33
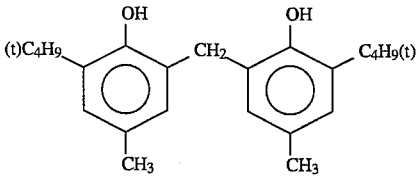
P-34
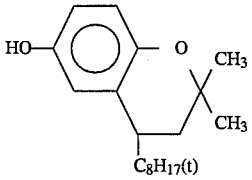
P-35
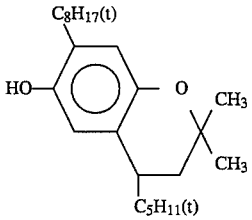
P-36
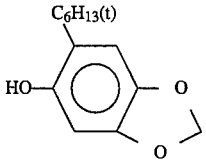
P-37
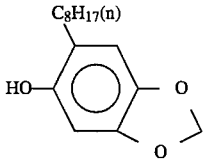
P-38
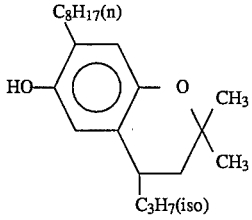
P-39
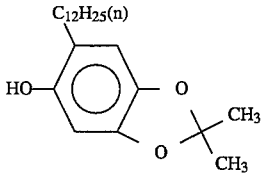

-continued

P-40

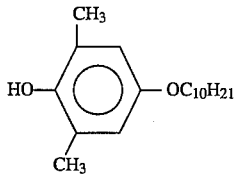

P-41

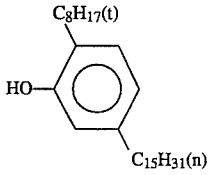

P-42

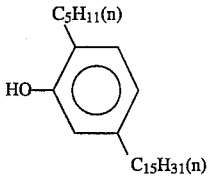

P-43

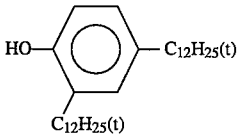

P-44

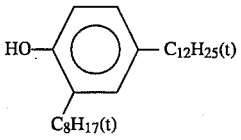

P-45

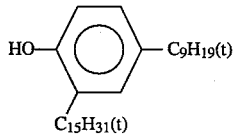

P-46

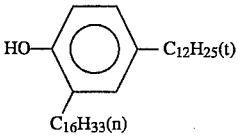

P-47

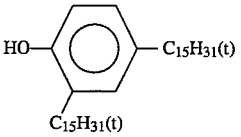

P-48

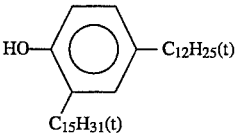

P-49

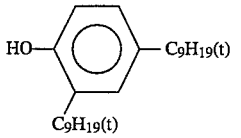

-continued

P-50

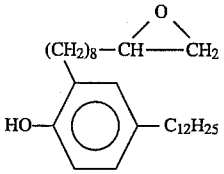

P-51

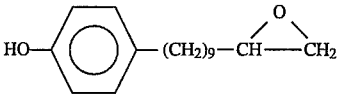

P-52

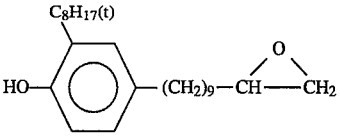

These high boiling organic solvents of phenol type can be easily prepared using the methods described, e.g., in U.S. Pat. No. 2,835,579, British Patents 1,801,9471 and 1,076,054, U.S. Pat. No. 4,124,396, and JP-A-62-247364.

Next, general formula (III) is described below in detail.

An alkyl group represented by $R_7$, $R_8$, or $R_9$ includes those containing 1 to 32 carbon atoms, each of alkenyl and alkinyl groups represented thereby includes those containing 2 to 32 carbon atoms, and each of cycloalkyl and cycloalkenyl groups represented thereby includes those containing 3 to 12 carbon atoms. Those alkyl, alkenyl and alkinyl groups may take a straight-chain or branched form. Also, the foregoing groups include substituted ones.

An aryl group represented by $R_7$, $R_8$, or $R_9$ is preferably a substituted or unsubstituted phenyl group.

A heterocyclyl group represented by $R_7$, $R_8$, or $R_9$ is preferably a 4- to 8-membered heterocyclyl group, much preferably a 5- to 7-membered heterocyclyl group which may be a constituent of a condensed ring. Also, these groups include substituted ones.

An alkoxy group represented by $R_7$, $R_8$ or $R_9$ includes substituted ones, and examples thereof are methoxy group, ethoxy group, isopropoxy group, t-butoxy group, ethylhexyloxy group, dodecyloxy group, octadecyloxy group, ethoxyethyloxy group, phenetyloxy group and the like.

An aryloxy group represented by $R_7$, $R_8$ or $R_9$ is preferably a phenoxy group, the aryl nucleus of which may be substituted. Examples thereof include phenoxy group, p-t-butylphenoxy group, m-pentadecylphenoxy group and so on.

A heterocyclyloxy group represented thereby is preferably one which contains a 4- to 8-membered heterocyclic ring, much preferably one which contains a 5- to 7-membered heterocyclic ring. Such a heterocyclic ring may be substituted. Specific examples of said group include 3,4,5,6-tetrahydropyranyl-2-oxy group and 1-phenyltetrazole-5-oxy group.

Groups represented by $R_{10}$ or $R_{11}$ include the same groups as cited above as examples of $R_7$, $R_8$ or $R_9$.

As for the group represented by Y, carbonyl and sulfonyl groups are especially favored by the compounds represented by general formula (III).

Groups represented by $R_{12}$ include the same groups as cited above as examples of $R_7$, $R_8$ or $R_9$.

In the compounds represented by general formula (III), a ring may be formed by combining $R_7$ with $R_8$, $R_8$ with $R_9$, or $R_9$ with $R_{10}$.

The compounds preferred in the present invention are those containing a hydrogen atom as $R_9$, the compounds further containing an optionally substituted aryl or alkyl group as each of $R_7$, $R_8$, $R_{10}$ and $R_{11}$ are much preferred, and the particularly preferred compounds are those satisfying the additional requirement that at least one among $R_7$, $R_8$, $R_{10}$ and $R_{11}$ is an aryl group.

Specific examples of the high boiling organic solvents represented by general formula (III) are illustrated below. However, the invention should not be construed as being limited to these examples.

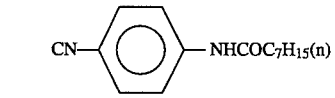

A-1

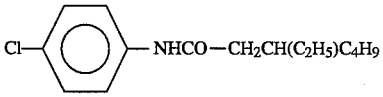

A-2

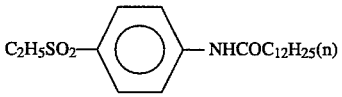

A-3

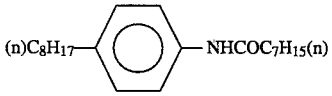

A-4

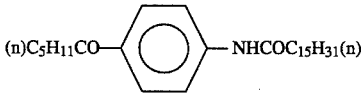

A-5

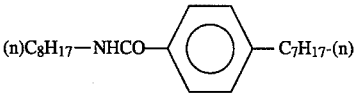

A-6

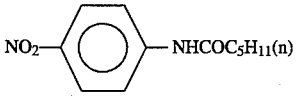

A-7

$(n)C_{11}H_{23}CON(C_2H_5)_2$ A-8

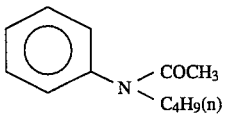

A-9

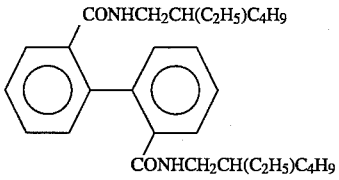

A-10

$(n)C_{11}H_{23}CONH—CH_2CH(C_2H_5)C_4H_9$ A-11

$(n)C_7H_{15}CONH—CH_2CH(C_2H_5)C_4H_9$ A-12

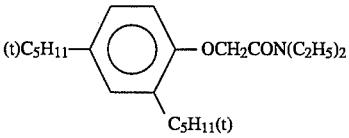

A-13

-continued

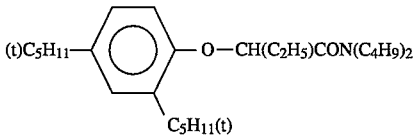

A-14

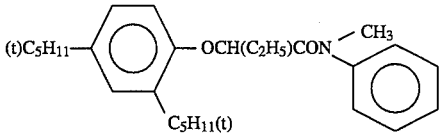

A-15

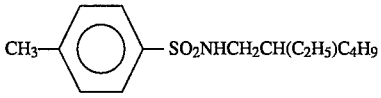

A-16

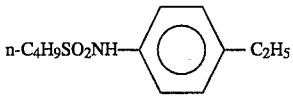

A-17

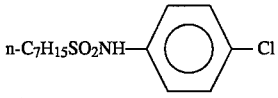

A-18

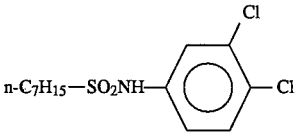

A-19

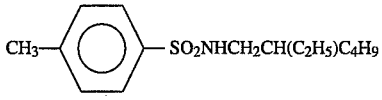

A-20

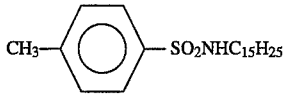

A-21

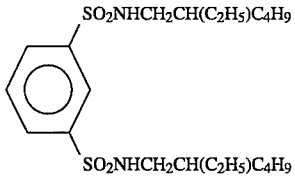

A-22

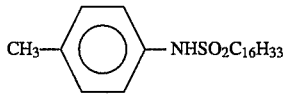

A-23

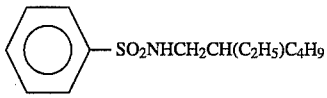

A-24

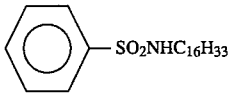

A-25

$n\text{-}C_{11}H_{23}SO_2NHCH_2CH(C_2H_5)C_4H_9$ A-26

$n\text{-}C_7H_{15}SO_2NH—C_9H_{19}$ A-27

-continued

A-28

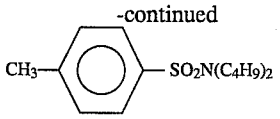

A-29

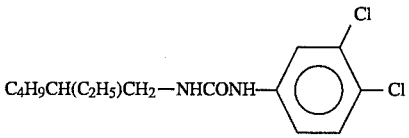

A-30

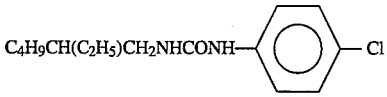

A-31

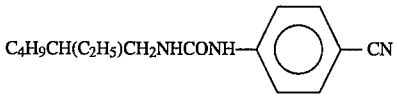

A-32

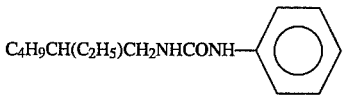

A-33 $(n)C_{11}H_{23}NHCONHC_{11}H_{23}(n)$

A-34

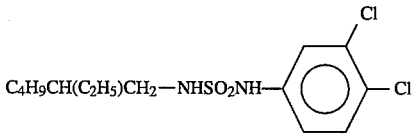

A-35

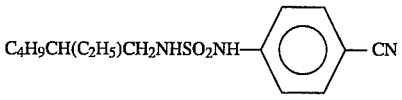

A-36 $(n)C_{11}H_{23}NHSO_2NHC_{11}H_{23}(n)$

A-37

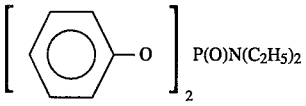

A-38

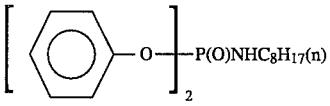

A-39

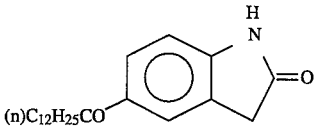

A-40

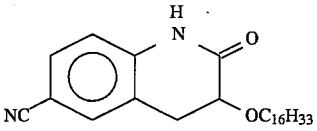

A-41

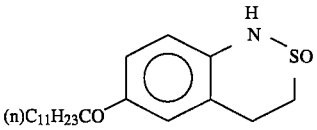

-continued

A-42

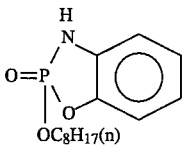

A-43

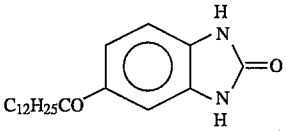

The present compounds represented by general formula (III) can be synthesized according to conventional methods as described, e.g., in EP-A1-0309158, EP-A1-0309159, EP-A1-0309160, JP-A-02-171743 and JP-A-03-91742.

In using the high boiling organic solvents of the present invention together with the present cyan couplers represented by general formula (Ia), the amount of the present high boiling organic solvent can be properly determined depending on the sort and the amount of the cyan coupler used together. When the present high boiling organic solvents are used individually, the amount thereof is preferably from 50 to 800 parts by weight, much preferably from 110 to 700 parts by weight, and particularly preferably from 160 to 500 parts by weight, per 100 parts by weight of the present cyan coupler.

The present high boiling organic solvents may be used individually or as a mixture of two or more thereof. Also, they can be blended with other high boiling organic solvents, such as phosphate solvents, phthalate solvents, aliphatic carboxylic acid esters and so on, so far as said blending does not lessen the effect of the present invention. When the present high boiling organic solvents are used as a blend with other high boiling organic solvents, it is desirable that the present ones comprise at least 50 wt %, preferably at least 60 wt %, and much preferably at least 70 wt %, of the resulting blend. In case the present high boiling organic solvents are blended with other high boiling organic solvents, the whole amount of the high boiling organic solvents used is preferably from 110 to 800 parts by weight, much preferably from 160 to 700 parts by weight, and particularly preferably from 310 to 500 parts by weight, per 100 parts by weight of the present cyan coupler.

In incorporating the foregoing couplers in a light-sensitive layer by using the foregoing high boiling organic solvents, various arts can be employed. Usually, oil-in-water dispersion processes known as the oil-protected method can be adopted therein. Specifically, one process comprises dissolving a coupler in a solvent and dispersing the resulting solution into a surfactant-containing aqueous gelatin solution in an emulsified condition, and another process comprises adding water or an aqueous gelatin solution to a surfactant-containing coupler solution and causing phase inversion therein to convert the mixed solution into an oil-in-water dispersion.

As emulsifying apparatuses which can be used for preparing emulsified dispersions as described above, there are high-speed stirring type dispersing devices which have great shearing force, dispersing devices which can provide high intensity of ultrasonic energy, and so on. More specifically, a colloid mill, a homogenizer, a capillary tube-type emulsifying apparatus, a liquid siren, an electromagnetic stress-type ultrasonic generator, an emulsifying apparatus with Porman-whistle, and so on can be instanced. High-speed stirring type dispersing devices which are suitably used in the present invention are dispersing devices whose pivotal part in dispersing action can rotate at a high speed (500–15, 000 r.p.m., preferably 2,000–4,000 r.p.m. ) in liquid, with specific examples including Dissolver, Polytron, Homomixer, Homoblender, Kady Mill, Jet-agitor and so on. In particular, it is preferable for the high-speed stirring type dispersing devices used in the present invention to be included in those called Dissolver or a high speed impeller type dispersing device and, as disclosed in JP-A-55-129136, to be equipped with an impeller installation comprising a high-speed rotatable shaft to which serrated blades bent upwardly or downwardly are attached so as to arrange the upwardly bent blades alternately with the downwardly bent blades.

Also, the coupler dispersions may be mixed with photographic emulsions after low boiling organic solvents are removed therefrom using a distillation, noodle-washing, ultrafiltration or some other means.

Low boiling organic solvents which can be used in preparing emulsified dispersions are organic solvents having a boiling point in the range of 30° to 150° C., with specific examples including lower alkyl acetates such as ethyl acetate, butyl acetate, etc., ethyl propionate, secondary butyl alcohol, methyl isobutyl ketone, β-ethoxyethyl acetate, methyl cellosolve acetate and so on.

In still another process which can be employed, loadable latex polymers (as disclosed, e.g., in U.S. Pat. No. 4,203, 716) are impregnated with the foregoing couplers in the presence of the foregoing high boiling organic solvents, or the foregoing couplers are dissolved in the presence of the foregoing high boiling organic solvents into organic solvents which contain polymers insoluble in water but soluble in said solvents, and then dispersed into aqueous hydrophilic-collid solutions in an emulsified condition.

Polymers which can be preferably used therein include the homo- and copolymers disclosed in WO 88/00723, from page 12 to page 50. In particular, the polymers of acrylamide type are favored in view of color image stabilization and so on.

Reduction in the particle size of the foregoing coupler dispersoid can be achieved by (i) choosing a proper surfactant, (ii) increasing the amount of a surfactant used, (iii) increasing the viscosity of a hydrophilic colloid solution used, (iv) decreasing the viscosity of the present coupler-dissolved organic phase, e.g., by the combined use with low boiling organic solvents as described above, (v) strengthening the shearing power of an emulsifying apparatus used, e.g., by increasing the rotating speed of stirring blades, (vi) prolonging the emulsification time, or/and so on.

When the present coupler-containing oleophilic particles are too large in size, there occurs a problem such that the generated color becomes muddy due to brown stain which is formed when the emulsion containing such particles and the photosensitive material having the coating of said emulsion are stored under the condition of high temperature and high humidity; whereas when such particles are too small in size they cause a problem of insufficiency in generated color density.

Therefore, it is desirable that the present coupler-containing oleophilic particles have a diameter of 0.08 to 0.5 μm, preferably 0.1 to 0.4 μm. The diameters of oleophilic fine particles can be determined with a measuring device such as Nanosizer, made by British Coulter Co., Ltd.

Silver halides which can be used in the present invention are silver chloride, silver bromide, silver (iodo)chlorobromide, silver iodobromide and so on. In particular, it is desirable for rapid processing to use a substantially iodide-free silver chlorobromide emulsion having a chloride content of at least 90 mole %, preferably at least 95 mole %, and particularly preferably at least 98 mole %, or silver chloride emulsion.

For the purpose of enhancement of image sharpness and the like, it is desirable to add dyes capable of undergoing decolorization by photographic processing (especially oxonol dyes), which are disclosed at pages 27 to 76 in EP-A2-0337490, to a hydrophilic colloid layer of the present photosensitive material in such an amount as to impart an optical reflection density of at least 0.70 at 680 nm to the resulting photosensitive material, and to incorporate titanium oxide grains which have undergone surface treatment with a di- to tetrahydric alcohol (e.g., trimethylolethane) or the like in a content of at least 12 wt % (preferably at least 14 wt % ) into a waterproof resin layer which constitutes the support of the present photosensitive material.

High boiling organic solvents which can be used for photographic additives, including magenta and yellow couplers capable of using in the present invention, are water-immiscible compounds which not only have a melting point of 100° C. or lower and a boiling point of 140° C. or higher but also are good solvents for couplers. The melting point of desirable high boiling organic solvents is 80° C. or lower and the boiling point thereof is 160° C. or higher, preferably 170° C. or higher.

Details of such high boiling organic solvents are described in JP-A-62-215272, from the right lower column at page 137 to the right upper column at page 144.

Also, a loadable latex polymer (as disclosed, e.g., in U.S. Pat. No. 4,203,716) impregnated with a cyan, magenta or yellow coupler in the presence (or absence) of a high boiling organic solvent as described above or a magenta or yellow coupler dissolved in a polymer insoluble in water but soluble in an organic solvent in the presence (or absence) of a high boiling organic solvent can be dispersed into a hydrophilic colloid solution in an emulsified condition.

Polymers which can be preferably used therein include the homo- or copolymers disclosed in U.S. Pat. No. 4,857, 449, from column 7 to column 15, and WO 88/00723, from page 12 to page 30. Much preferably, polymers of methacrylate or acrylamide type, especially those of acrylamide type, are favored over others in view of color image stabilization and so on.

In addition, it is desirable that compounds for improving the keeping quality of dye images, such as those disclosed in EP-A2-0277589, be used together with the couplers in the photosensitive material of the present invention. In particular, it is preferable for such compounds to be used in combination with pyrazoloazole couplers and the present pyrrolotriazole couplers.

That is, compounds of the kind which can produce chemically inert, substantially colorless compounds by combining chemically with an aromatic amine developing agent remaining after the color development-processing (Compound F) and/or compounds of the kind which can produce chemically inert, substantially colorless compounds by combining chemically with the oxidized aromatic amine developing agent remaining after the color development-processing (Compound G) are preferably used in combination or independently. By the use of these compounds, the generation of stains which is due to the formation of dyes through the reaction between the couplers and the unoxidized or oxidized color developing agent remaining in the processed photographic film, and the occurrence of other side reactions upon storage after photographic processing, can be inhibited effectively.

Also, it is desirable that the antimolds disclosed, e.g., in JP-A-63-271247 be added to the photosensitive material of the present invention in order to prevent the deterioration of images from occurring through propagation of various kinds of molds and bacteria in the hydrophilic colloid layers.

As for the support of the present photosensitive material, a support of the white polyester type or a support provided with a white pigment-containing layer on the same side as the silver halide emulsion layers may be adopted for display use. Further, it is desirable for improving sharpness that an antihalation layer be provided on the emulsion layer side or the reverse side of the support. In particular, it is preferable that the transmission density of the support be adjusted to the range of 0.35 to 0.8 so that a display may be enjoyed by means of both transmitted and reflected rays of light.

The photosensitive material of the present invention may be exposed to either visible or infrared rays of light. For the exposure, not only low intensity exposure but also high intensity short-time exposure may be employed. However, short-time exposure systems in which the exposure time per picture element is shorter than $10^{-3}$ second are preferable for the present invention. In particular, a laser scanning exposure system in which the exposure time per picture element is shorter than $10^{-4}$ second is favored over others.

Upon exposure, it is advantageous to use the band stop filter disclosed in U.S. Pat. No. 4,880,726. This filter can get rid color stain of optical origin to improve color reproducibility to a great extent.

The optically exposed photosensitive material can be subjected to conventional color photographic processing. In order to effect rapid processing, however, it is advantageous to the photosensitive material to undergo a bleach-fix operation after a color-development operation. In a special case such that emulsions having a high chloride content as described hereinbefore are used, it is desirable for accelerating the desilvering speed that the pH of a bleach-fix bath be not higher than about 6.5, preferably not higher than about 6.

Silver halide emulsions, other ingredients (such as additives, etc.) and photographic constituent layers (including their order of arrangement) which can be preferably used in the present photosensitive materials, and photographic processing methods and additives for photographic processing which can be preferably employed for processing the present photosensitive material are those disclosed in the following patent specifications, especially in EP-A2-0355660 (corresponding to JP-A-02-139544).

| Photographic Constituents and Related Matters | JP-A-62-215272 | JP-A-02-33144 | EP-A2-0355660 |
|---|---|---|---|
| Silver halide emulsions | from 6th line in right upper column at page 10 to 5th line in left lower column at page 12, and from 4th line from the bottom of right lower column at page 12 to 17th line in left upper column at page 13 | from 16th line in right upper column at page 28 to 11th line in right lower column at page 29, and from 2nd line to 5th line at page 30 | from 53rd line at page 45 to 3rd line at page 47, and from 20th line to 22nd line at page 47 |
| Silver halide solvents | from 6th line to 14th line in left lower column at page 12, and from 3rd line from the bottom of left upper column at page 13 to the end line in left lower column at page 18 | — | — |
| Chemical sensitizers | from 3rd line from the bottom of left lower column to 5th line from the bottom of right lower column at page 12, and from 1st line in right lower column at page 18 to 9th line from the bottom of right upper column at page 22 | from 12th line to end line in right lower column at page 29 | from 4th line to 9th line at page 47 |
| Spectral sensitizers (including spectral sensitization methods) | from 8th line from the bottom of right upper column at page 22 to end line at page 38 | from 1st to 13th in left upper column at page 30 | from 10th line to 15th line at page 47 |
| Emulsion stabilizers | from 1st line in left upper column at page 39 to end line in right upper column at page 72 | from 14th line in left upper column to 1st line in right upper column at page 30 | from 16th line to 19th line at page 47 |
| Development accelerators | from 1st line in left lower column at page 72 to 3rd line in right upper column at page 91 | — | — |
| Color couplers (cyan, magenta and yellow couplers) | from 4th line in right upper column at page 91 to 6th line in left upper column at page 121<br>upper column at page 30 to 11th line in right lower column at page 35 | from 14th line in right upper column at page 3 to end line in left upper column at page 18, and from 6th line in right upper column at page 30 to 11th line in right lower column at page 35 | from 15th line to 27th line at page 4, from 30th line at page 5 to end line at page 28, from 29th line to 31st line at page 45, and from 23rd line at page 47 to 50th line at page 63 |
| Color formation reinforcing agent | from 7th line in left upper column at page 121 to 1st line in right upper column at page 125 | — | — |
| Ultraviolet absorbents | from 2nd line in right upper column at page 125 to end line | from 14th line in right lower column at page 37 to 11th line | from 22nd line to 31st line at page 65 |

-continued

| Photographic Constituents and Related Matters | JP-A-62-215272 | JP-A-02-33144 | EP-A2-0355660 |
|---|---|---|---|
| | in left lower column at page 127 | in left upper column at page 38 | |
| Discoloration inhibitors (image stabilizers) | from 1st line in right lower column at page 127 to 8th line in left lower column at page 137 | from 12th line in right upper column at page 36 to 19th line in left upper column at page 37 | from 30th line at page 4 to 23rd line at page 5, from 1st line at page 29 to 25th line at page 45 from 33rd line to 40th line at page 45, and from 2nd line to 21st line at page 65 |
| High boiling and/or low boiling organic solvents | from 9th line in left lower column at page 137 to end line in right upper column at page 144 | from 14th line in right lower column at page 35 to 4th line from the bottom of left upper column at page 36 | from 1st line to 51st line at page 64 |
| Dispersion methods for photographic additives | from 1st line in left lower column at page 144 to 7th line in right upper column at page 146 | from 10th line in right lower column at page 27 to end line in left upper column at page 28, and from 12th line in right lower column at page 35 to 7th line in right upper column at page 36 | from 51st line at page 63 to 56th line at page 64 |
| Hardeners | from 8th line in right upper column at page 146 to 4th line in left lower column at page 155 | — | — |
| Precursors of developing agent | from 5th line in left lower column to 2nd line in right lower column at page 155 | — | — |
| Development inhibitor releasing compounds | from 3rd line to 9th line in right lower column at page 155 | — | — |
| Supports | from 19th line in right lower column at page 155 to 14th line in left upper column at page 156 | from 18th line in right upper column at page 38 to 3rd line in left upper column at page 39 | from 29th line at page 66 to 13th line at page 67 |
| Light-sensitive layer constitution | from 15th line in left upper column at page 156 to 14th line in right lower column at page 156 | from 1st line to 15th line in right upper column at page 28 | from 41st line to 52nd line at page 45 |
| Dyes | from 15th line in right lower column at page 156 to end line in right lower column at page 184 | from 12th line in left upper column to 7th line in right upper column at page 38 | from 18th line to 22nd line at page 66 |
| Color stain inhibitors | from 1st line in left upper column at page 185 to 3rd line in right lower column at page 188 | from 8th line to 11th line in right upper column at page 36 | from 57th line at page 64 to 1st line at page 65 |
| Tone modifiers | from 4th line to 8th line in right lower column at page 188 | — | — |
| Stain inhibitors | from 9th line in right lower column at page 188 to 10th line in right lower column at page 193 | from end line in left upper column to 13th line in right lower column at page 37 | from 32nd line at page 65 to 17th line at page 66 |
| Surfactants | from 1st line in left lower column at page 201 to end line in right upper column at page 210 | from 1st line in right upper column at page 18 to end line in right lower column at page 24, and from 10th line from the bottom of left lower column to 9th line in right lower column at page 27 | — |
| Fluorine-containing compounds (antistatic agent, coating aids, lubricants, adhesion inhibitors, etc.) | from 1st line in left lower column at page 210 to 5th line in left lower column at page 222 | from 1st line in left upper column at page 25 to 9th line in right lower column at page 27 | — |
| Binders (hydrophilic colloids) | from 6th line in left lower column at page 222 to end line in left upper column at page 225 | from 8th line to 18th line in right upper column at page 38 | from 23rd line to 28th line at page 66 |
| Thickening agent | from 1st line in right upper column at page 225 to 2nd line in right upper column at page 227 | — | — |
| Antistatic agent | from 3rd line in right upper column at page 227 to 1st line in left upper column at page 230 | — | — |
| Polymer latexes | from 2nd line in left upper | — | — |

-continued

| Photographic Constituents and Related Matters | JP-A-62-215272 | JP-A-02-33144 | EP-A2-0355660 |
|---|---|---|---|
| | column at page 230 to end line at page 239 | | |
| Matting agent | from 1st line in left upper column to end line in right upper column at page 240 | — | — |
| Photographic processing methods (including processing steps, additives, and so on) | from 7th line in right upper column at page 3 to 5th line in right upper column at page 10 | from 4th line in left upper column at page 39 to end line in left upper column at page 42 | from 14th line at page 67 to 28th line at page 69 |

Note)
The quoted paragraphs of JP-A-62-21527 are intended to include the contents of amendments dated March 16 in 1987 which were given in the end of the bulletin.

As for the yellow coupler among the above-cited color couplers, the so-called blue-shift couplers disclosed in JP-A-63-231451, JP-A-63-123047, JP-A-63-241547, JP-A-01-173499, JP-A-01-213648 and JP-A-01-250944 are preferably used in addition to those cited in the above references. Much preferably, the yellow couplers of cycloalkane series acylacetanilide type disclosed in JP-A-04-116643 and the yellow couplers of indolinoacetanilide type disclosed in JP-A-02-286341 are used.

As for the cyan coupler, on the other hand, not only diphenylimidazole type cyan couplers disclosed in JP-A-02-33144 but also 3-hydroxypyridine type cyan couplers disclosed in EP-A2-0333185 (especially one which is prepared by introducing a chlorine atom as a splitting-off group into Coupler (42) cited as a specific example to render the coupler two-equivalent, and Couplers (6) and (9) cited as specific examples) and cyclic active methylene type cyan couplers disclosed in JP-A-64-32260 (especially Couplers 3, 8 and 34 cited as specific examples) may be used together with the present cyan couplers.

In processing silver halide color photosensitive materials in which silver halide emulsions having a high chloride content of at least 90 mole % are used, the methods disclosed in JP-A-02-207250, from left upper column at page 27 to right upper column at page 34, are preferably employed.

The present invention will now be illustrated in more detail by reference to the following examples,

EXAMPLE 1

[Preparation of Sample 1]

The surface of a paper support laminated with polyethylene on both sides was subjected to corona discharge, and then provided with a gelatin subbing layer in which sodium dodecylbenzenesulfonate was incorporated. Thereon, various constituent layers described below were further coated to prepare a multilayer color photographic paper (Sample 1). Coating solutions used therein were prepared in the following manners.

Preparation of coating solution for Fifth Layer:

A cyan coupler (ExC) in an amount of 18 g, 10 g of an ultraviolet absorbent (UV-2), 0.6 g of a color image stabilizer (Cpd-9), 0.6 g of a color image stabilizer (Cpd-10), 0.6 g of a color image stabilizer (Cpd-11), 0.6 g of a color image stabilizer (Cpd-8), 0.6 g of a color image stabilizer (Cpd-6), 18 g of a color image stabilizer (Cpd-1) and 28 ml of a high boiling organic solvent (Solv-2) were admixed with 33 ml of ethyl acetate and dissolved thereinto, then added to 270 ml of a 20 % aqueous gelatin solution containing 7.0 g of sodium dodecylbenzenesulfonate, and further dispersed thereinto in an emulsified condition by means of a high-speed stirrer to prepare an emulsified dispersion. On the other hand, there were prepared two kinds of silver chlorobromide emulsions, one of which comprised large-size grains having a cubic crystal shape, an average size of 0.50 μm and a variation coefficient of 0.09 with respect to grain size distribution (a large-sized Emulsion C), and the other of which comprised small-size grains having a cubic crystal shape, an average size of 0.41 μm and a variation coefficient of 0.11 with respect to grain size distribution (a small-sized Emulsion C), said large-sized and small-sized grains-each being composed of 0.8 mol % of silver bromide which is localized in part of the grain surface and the remainder mol % of silver chloride. A red-sensitive sensitizing dye E illustrated below was added to the large-sized emulsion in an amount of $0.9\times10^{-4}$ mole/mole Ag and to the small-sized emulsion in an amount of $1.1\times10^{-4}$ mole/mole Ag. Then, the resulting large-sized and small-sized emulsions were mixed in a ratio of 1:4 on a silver basis to prepare a silver chlorobromide emulsion. Further, Compound F illustrated below was added to the silver chlorobromide emulsion in an amount of $2.6\times10^{-3}$ mole/mole Ag. Furthermore, the resulting emulsion was chemically ripened by adding thereto sulfur and gold sensitizers. The thus prepared red-sensitive silver chlorobromide emulsion and the foregoing emulsified dispersion were mixed homogeneously, and thereto were added other ingredients described below so as to obtain the coating solution for the fifth layer having the composition described below.

Coating solutions for the first to fourth layers, the sixth layer and the seventh layer were prepared in a similar manner to that for the fifth layer. In each layer, sodium salt of 1-oxy- 3,5-dichloro-s-triazine was used as gelatin hardener.

In addition, the following compounds (Cpd-14) and (Cpd-15) were added to all of the coating solutions so as to have the total coverages of 25.0 mg/m$^2$ and 50 mg/m$^2$, respectively.

Spectral sensitizing dyes illustrated below were added to silver chlorobromide emulsions used for the corresponding light-sensitive emulsion layers:

Blue-Sensitive Emulsion Layer

Sensitizing Dye A

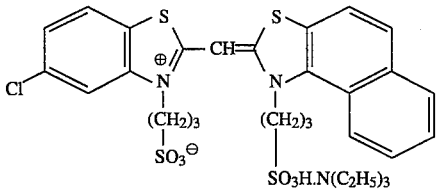

and

Sensitizing Dye B

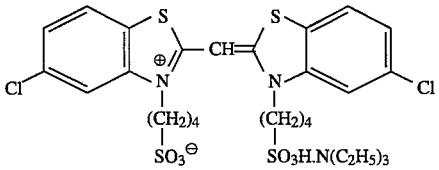

(which were each added to the large-sized emulsion in the amount of $2.0 \times 10^{-4}$ mole/mole Ag and to the small-sized emulsion in the amount of $2.5 \times 10^{-4}$ mole/mole Ag)

Green-Sensitive Emulsion Layer

Sensitizing Dye C

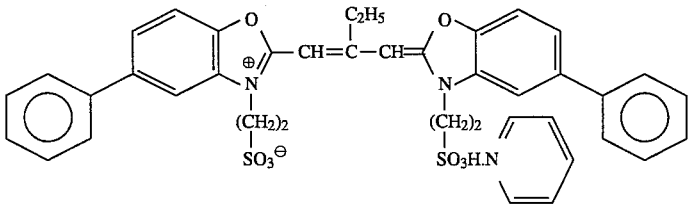

(which was added to the large-sized emulsion in the amount of $4.0 \times 10^{-4}$ mole/mole Ag and to the small-sized emulsion in the amount of $5.6 \times 10^{-4}$ mole/mole Ag)

Sensitizing Dye D

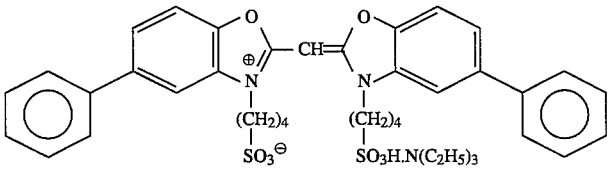

(which was added to the large-sized emulsion in the amount of $7.0 \times 10^{-5}$ mole/mole Ag and to the small-sized emulsion in the amount of $1.0 \times 10^{-5}$ mole/mole Ag)

Red-Sensitive Emulsion Layer

Sensitizing Dye E

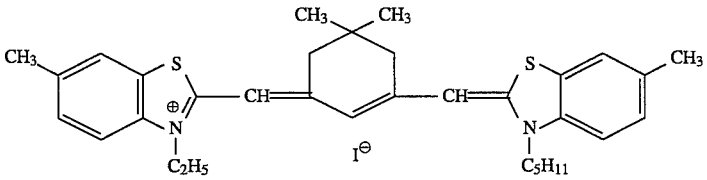

(which was added to the large-sized emulsion in the amount of $0.9 \times 10^{-4}$ mole/mole Ag and to the small-sized emulsion in the amount of $1.1 \times 10^{-4}$ mole/mole Ag)

-continued
Blue-Sensitive Emulsion Layer

Compound F

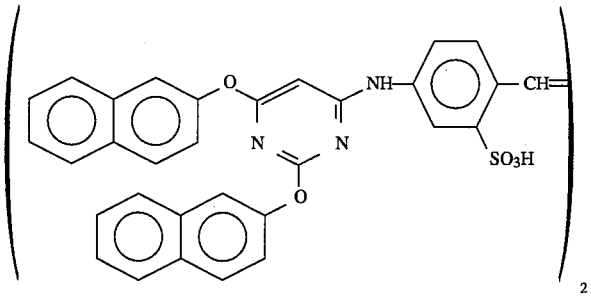

(which was added in the amount of $2.6 \times 10^{-3}$ molr/mole Ag)

Further, 1-(5-methylureidophenyl)-5-mercaptotetrazole was incorporated into the blue-sensitive, the green-sensitive and the red-sensitive emulsion layers in the amounts of $8.5\times10^{-5}$ mole/mole Ag, $7.7\times10^{-4}$ mole/mole Ag and $2.5\times10^{-4}$ mole/mole Ag, respectively. Furthermore, 4-hydroxy-6-methyl-1,3,3a,7-tetrazaindene was incorporated into the blue-sensitive and the green-sensitive emulsion layers in the amounts of $1\times10^{-4}$ mole/mole Ag and $2\times10^{-4}$ mole/mole Ag, respectively.

In addition, the dyes illustrated below (wherein each figure in parentheses represents the coverage thereof) were incorporated in the emulsion layers in order to prevent the irradiation phenomenon.

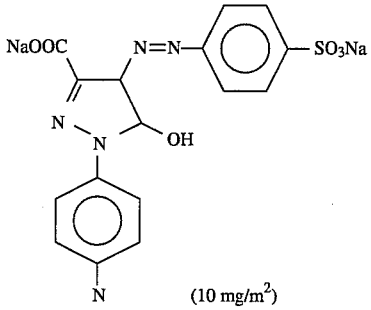

(10 mg/m$^2$)

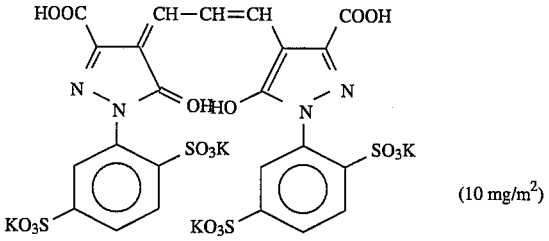

(10 mg/m$^2$)

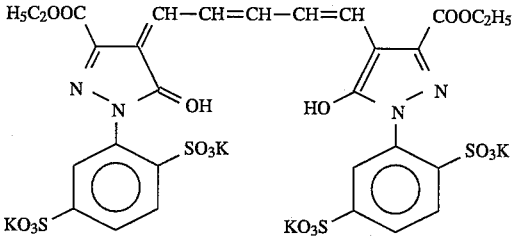

(40 mg/m$^2$)

-continued

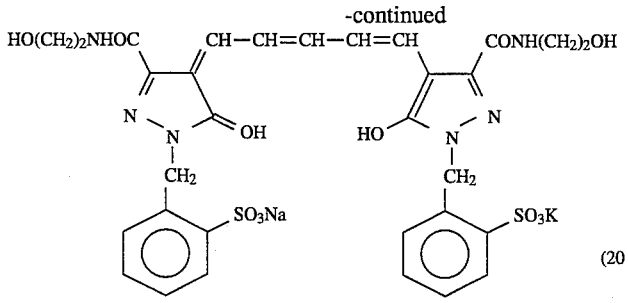

(20 mg/m$^2$)

[Layer Structure]

The composition of each constituent layer is described below. Each figure on the right side represents a coverage (g/m$^2$) of the ingredient corresponding thereto. As for the silver halide emulsion, the figure represents a coverage based on silver.

| | |
|---|---|
| Support: | |
| Polyethylene-laminated paper [containing white pigment ($TiO_2$) and a bluish dye (ultramarine) in the polyethylene laminate on the side of the first layer] | |
| First layer (blue-sensitive emulsion layer): | |
| Silver chlorobromide emulsion [3:7 (by mole based on Ag) mixture of a large-sized Emulsion A having a cubic crystal shape, an average grain size of 0.88 μm and a variation coefficient of 0.08 with respect to size distribution and a small-sized Emulsion A having a cubic crystal shape, an average grain size of 0.70 μm and a variation coefficient of 0.10 with respect to size distribution, which both contained 0.3 mol % of AgBr localized in part of the grain surface] | 0.27 |
| Gelatin | 1.36 |
| Yellow Coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| Second Layer (color stain inhibiting layer): | |
| Gelatin | 1.00 |
| Color stain inhibitor (Cpd-4) | 0.06 |
| Solvent (Solv-6) | 0.03 |
| Solvent (Solv-2) | 0.25 |
| Solvent (Solv-3) | 0.25 |
| Third layer (green-sensitive emulsion layer): | |
| Silver chlorobromide emulsion [1:3 (by mole based on Ag) mixture of a large-sized Emulsion B having a cubic crystal shape, an average grain size of 0.55 μm and a variation coefficient of 0.10 with respect to size distribution and a small-sized Emulsion B having a cubic crystal shape, an average grain size of 0.39 μm and a variation coefficient of 0.08 with respect to size distribution, which both contained 0.8 mol % of AgBr localized in part of the grain surface] | 0.13 |
| Gelatin | 1.45 |
| Magenta coupler (ExM) | 0.16 |
| Color image stabilizer (Cpd-5) | 0.15 |
| Color image stabilizer (Cpd-2) | 0.03 |
| Color image stabilizer (Cpd-6) | 0.01 |
| Color image stabilizer (Cpd-7) | 0.01 |
| Color image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (color stain inhibiting layer): | |
| Gelatin | 0.70 |
| Color stain inhibitor (Cpd-4) | 0.04 |
| Solvent (Solv-6) | 0.02 |
| Solvent (Solv-2) | 0.18 |
| Solvent (Solv-3) | 0.18 |
| Fifth layer (red-sensitive emulsion layer): | |
| Silver chlorobromide emulsion [1:4 (by mole based on Ag) mixture of a large-sized Emulsion C having a cubic crystal shape, an average | 0.09 |

-continued

| | |
|---|---|
| grain size of 0.50 μm and a variation coefficient of 0.09 with respect to size distribution and a small-sized Emulsion C having a cubic crystal shape, an average grain size of 0.41 μm and a variation coefficient of 0.11 with respect to size distribution, which both contained 0.8 mol % of AgBr localized in part of the grain surface] | |
| Gelatin | 0.85 |
| Cyan coupler (ExC) | 0.18 |
| Ultraviolet absorbent (UV-2) | 0.1 |
| Color image stabilizer (Cpd-9) | 0.006 |
| Color image stabilizer (Cpd-10) | 0.006 |
| Color image stabilizer (Cpd-11) | 0.006 |
| Solvent (Solv-2) | 0.29 |
| Color image stabilizer (Cpd-8) | 0.006 |
| Color image stabilizer (Cpd-6) | 0.006 |
| Color image stabilizer (Cpd-1) | 0.18 |
| Sixth layer (ultraviolet absorbing layer): | |
| Gelatin | 0.55 |
| Ultraviolet absorbent (UV-1) | 0.38 |
| Color image stabilizer (Cpd-12) | 0.15 |
| Color image stabilizer (Cpd-5) | 0.02 |
| Seventh layer (protective layer): | |
| Gelatin | 1.13 |
| Acryl-modified polyvinyl alcohol copolymer (modification degree: 17%) | 0.05 |
| Liquid paraffin | 0.02 |
| Color image stabilizer (Cpd-13) | 0.01 |

(ExC) Cyan Coupler
3:7 (by mole) Mixture of

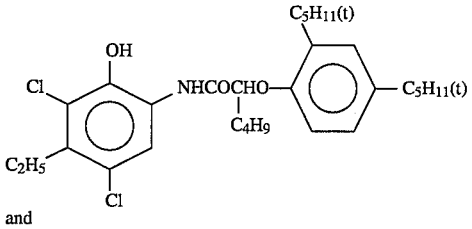

and

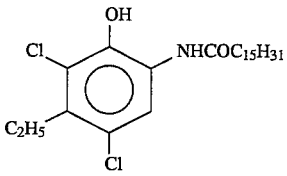

(ExY) Yellow Coupler

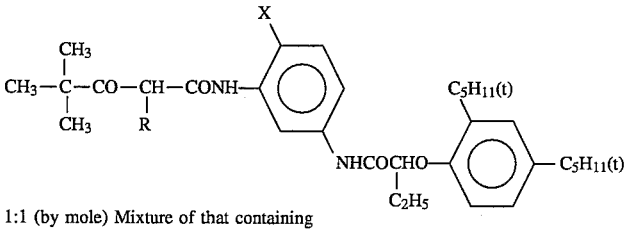

1:1 (by mole) Mixture of that containing

R = 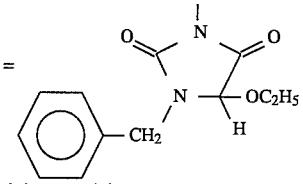

X = Cl and that containing

R = 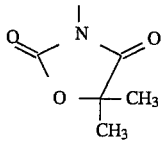

X = $OCH_3$.

-continued
(ExM) Magenta Coupler
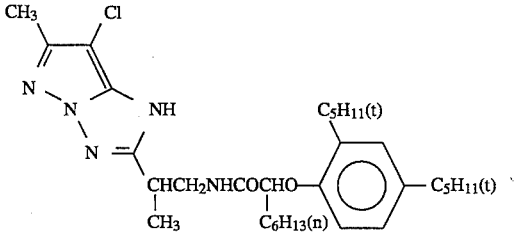
(Cpd-1) Color Image Stabilizer
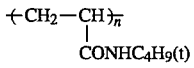
average molecular weight: 60,000
(Cpd-2) Color Image Stabilizer
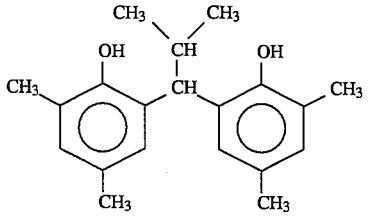
(Cpd-3) Color Image Stabilizer
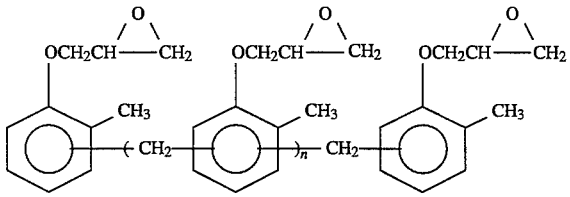
n = 7–8 (on average)
(Cpd-4) Color Stain Inhibitor
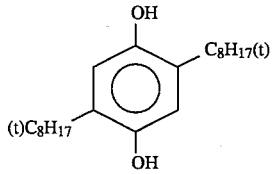
(Cpd-5) Color Image Stabilizer
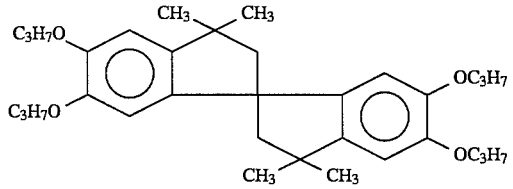
(Cpd-6) Color Image Stabilizer
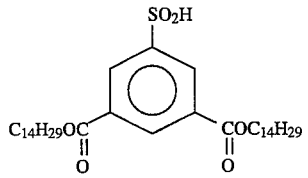
(Cpd-7) Color Image Stabilizer -continued
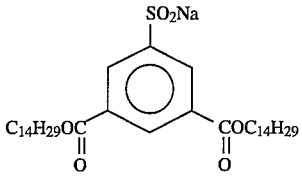
(Cpd-8) Color Image Stabilizer
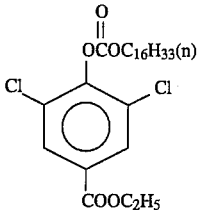
(Cpd-9) Color Image Stabilizer
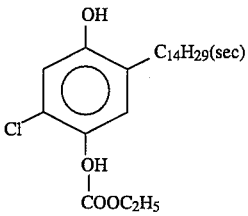
(Cpd-10) Color Image Stabilizer
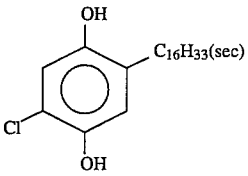
(Cpd-11) Color Image Stabilizer
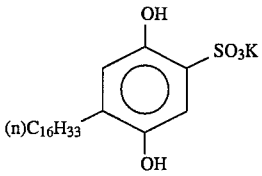
(Cpd-12)
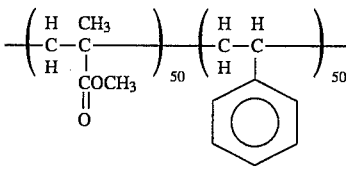
average molecular weight: 60,000
(Cpd-13)
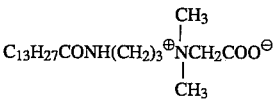
(Cpd-14) Antiseptic
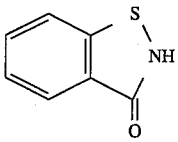

-continued
(Cpd-15) Antiseptic
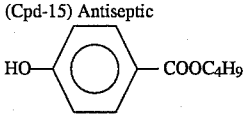
(UV-1) Ultraviolet Abosrbent
10:5:1:5 (by weight) Mixture of the following (1), (2), (3) and (4)
(1)
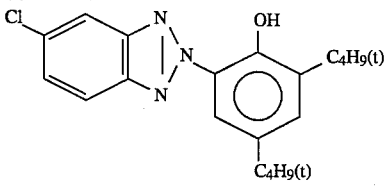
(2)
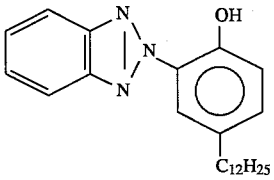
(3)
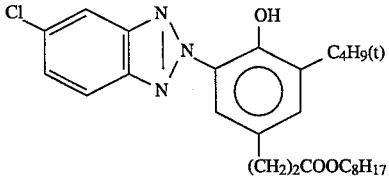
(4)
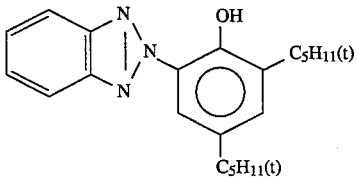
(UV-2) Ultraviolet Absorbent
1:2:2 (by weight) Mixture of the following (1), (2) and (3)
(1)
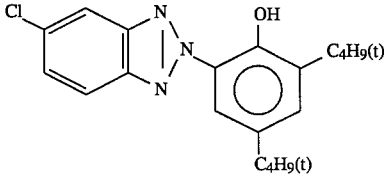
(2)
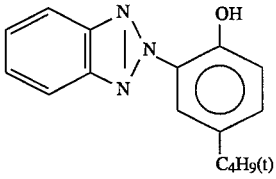

-continued (3)

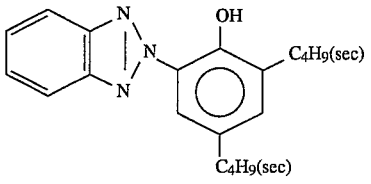

(Solv-1) Solvent $C_8H_{17}CHCH(CH_2)_7COOC_8H_{17}$ (O)

(Solv-2) Solvent

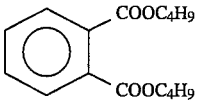

(Solv-3) Solvent

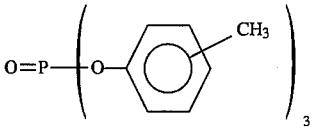

(Solv-4) Solvent

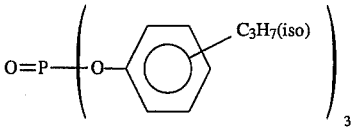

(Solv-5) Solvent $O{=}P{\leftarrow}OCH_2CH(C_2H_5)C_4H_9(n))_3$ (Solv-6) Solvent

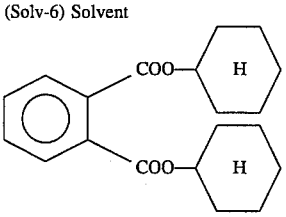

(Solv-7) Solvent

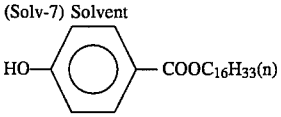

Then, the sample was subjected to gradation exposure using a sensitometer (Model FWH, produced by Fuji Photo Film Co., Ltd., whose light source has a color temperature of 3,200° K.) through a red filter for sensitometry. The exposure therein was performed under a condition such that the exposure time was 0.1 second and the amount of exposure was 250 CMS.

The thus exposed sample was used for continuous processing (running test) by means of a paper processing machine in which the processing operation was performed in accordance with the following processing steps using the processing solutions having the compositions described below respectively. Therein, the processing was continued until the volume of the replenisher used in color development became twice the volume of the color developing tank.

| Processing Step | Temperature | Time | Amount replenished* | Tank Volume |
|---|---|---|---|---|
| Color Development | 35° C. | 45 sec. | 161 ml | 17 l |
| Bleach-Fix | 35° C. | 45 sec. | 215 ml | 17 l |
| Stabilization (1) | 35° C. | 20 sec. | — | 10 l |
| Stabilization (2) | 35° C. | 20 sec. | — | 10 l |

-continued

| Processing Step | Temperature | Time | Amount replenished* | Tank Volume |
|---|---|---|---|---|
| Stabilization (3) | 35° C. | 20 sec. | — | 10 l |
| Stabilization (4) | 35° C. | 20 sec. | 248 ml | 10 l |
| Drying | 80° C. | 60 sec. | | |

*per $m^2$ of photosensitive material.

The stabilization was carried out according to the four-stage counter current process, from the step (4) toward the step (1).

The composition of each processing solution is described below.

| Color Developer: | Tank Soln. | Replenisher |
|---|---|---|
| Water | 800 ml | 800 ml |
| 1-Hydroxyethylidene-1,1-diphosphonic acid (60%) | 0.8 ml | 0.8 ml |
| Lithium sulfate (anhydrous) | 2.7 g | 2.7 g |
| Triethanolamine | 8.0 g | 8.0 g |
| Sodium chloride | 1.4 g | — |
| Potassium bromide | 0.03 g | 0.025 g |
| Diethylhydroxylamine | 4.6 g | 7.2 g |
| Potassium carbonate | 27 g | 27 g |
| Sodium sulfite | 0.1 g | 0.2 g |
| N-ethyl-N-(β-methanesulfonamido-ethyl)-3-methyl-4-aminoaniline 3/2 sulfate monohydrate | 4.5 g | 7.3 g |
| Brightening agent (4,4-diamino-stilbene type) | 2.0 g | 3.0 g |
| Water to make | 1000 ml | 1000 ml |
| pH (25° C.) adjusted to | 10.25 | 10.80 |

| Bleach-Fix Bath (Tank Solution = Replenisher): | |
|---|---|
| Water | 400 ml |
| Ammonium thiosulfate (700 g/l) | 100 ml |
| Sodium sulfite | 17 g |
| Ammonium ethylenediaminetetraacetonato-ferrate(III) | 55 g |
| Disodium ethylenediaminetetraacetate | 5 g |
| Glacial acetic acid | 1000 ml |
| Water to make | 1000 ml |
| pH (25° C.) adjust to | 5.40 |

| Stabilizing Bath (Tank solution = Replenisher): | |
|---|---|
| Benzoisothiazoline-3-one | 0.02 g |
| Polyvinylpyrrolidone | 0.05 g |
| Water to make | 1000 ml |
| pH (25° C.) adjusted to | 7.40 |

[Preparation of Samples 2 to 9]

Samples 2 to 9 were prepared in the same manner as the foregoing Sample 1, except that the cyan coupler and the high boiling organic solvent used in preparing the emulsified dispersion for the coating solution of the fifth layer were replaced so as to be shown in Table 1, and then subjected to the same exposure and photographic processing operations as Sample 1. Therein, each coupler was used in the amount equimolar with ExC used in Sample 1, and each high boiling organic solvent was used in the amount of 160 parts by weight per 100 parts by weight of the coupler used in combination therewith. The couplers used for comparison were ExC and E-1 illustrated below, and the high boiling organic solvent used for comparison was Solv-2.

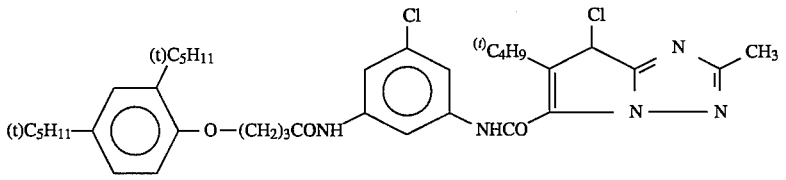

[Evaluation of Samples]

Densities of each processed sample in the area with the maximal color generation were measured with red rays of light, green rays of light and blue rays of light respectively, and thereby were determined a ratio of the density measured with green rays of light to the density measured with red rays of light ($D_{mG}$) and a ratio of the density measured with blue rays of light to the density measured with red rays of light ($D_{mB}$). $D_{mG}$ and $D_{mB}$ are adopted herein as a criterion of color reproducibility. Specifically, these values signify that the reproduction of cyan color is more satisfactory the smaller they are.

TABLE 1

| Sample | Coupler | High Boiling Organic Solvent | $D_{mG}$ | $D_{mB}$ | Note |
|---|---|---|---|---|---|
| 1 | ExC | Solv-2 | 0.35 | 0.29 | comparison |
| 2 | ExC | P-10 | 0.32 | 0.27 | " |
| 3 | ExC | A-1 | 0.32 | 0.27 | " |
| 4 | E-1 | Solv-2 | 11.11 | 0.39 | " |
| 5 | E-1 | P-10 | 8.65 | 0.33 | " |
| 6 | E-1 | A-1 | 8.20 | 0.30 | " |
| 7 | C-21 | Solv-2 | 0.35 | 0.17 | " |
| 8 | C-21 | P-10 | 0.21 | 0.17 | invention |
| 9 | C-21 | A-1 | 0.21 | 0.17 | " |

As can be clearly seen from Table 1, the dye generated from Coupler E-1 used for comparison, which is not included in the present cyan couplers though it is one of the couplers of pyrrolotriazole type, had excessively great $D_{mG}$ values even in the cases said coupler was used in combination with the present high boiling organic solvents, not to speak of the case in which said coupler was used in combination with the high boiling organic solvent for comparison, so that it did not assume a cyan color in any case (Samples 4 to 6). Also, it has turned out that the dye generated from the coupler of phenol type had a great $D_{mB}$ value irrespective of any high boiling organic solvent the coupler was used in combination with (Samples 1 to 3). This result indicates that the generated color was considerably muddy due to the absorption in a blue region of the spectrum, which is also undesirable in view of color reproduction.

On the other hand, the cyan dye generated from the pyrrolotriazole type coupler of the present invention was small in $D_{mB}$ value but still great in $D_{mG}$ value when said coupler was used in combination with a high boiling organic solvent other than the present ones, such as Solv-2 (Sample 7). That is to say, it has proved from this result that the generated color was considerably muddy due to the absorption in a green region of the spectrum, so that it cannot be said in this case also that color reproduction is improved to a satisfactory degree.

In contrast, the dye generated from the present pyrrolotriazole type coupler was small in both $D_{mG}$ and $D_{mB}$ in the cases said coupler was used in combination with the present high boiling organic solvents (Samples 8 and 9). From this result, it has proved that only the combined use according to the present invention can ensure both satisfactory hue and excellent color reproduction.

EXAMPLE 2

[Preparation of Samples 10 to 95]

Samples 10 to 95 were prepared in the same manner as Sample 1 used in Example 1, except that the cyan coupler ExC and the high boiling organic solvent Solv-2 used in preparing the emulsified dispersion for the coating solution of the fifth layer were replaced so as to be shown in Table 2, and then subjected to the same exposure and photographic processing operations as Sample 1. Therein, each coupler was used in the amount equimolar with ExC used in Sample 1, and each high boiling organic solvent was used in the amount corresponding to the high boiling organic-solvent/coupler ratio (by weight) set forth in Table 2. In case of using 4-equivalent couplers, the coverage of the resulting emulsion was adjusted so that the content of silver halide in the emulsion layer might be twice that of Sample 1. The coupler used for comparison was ExC, and the high boiling organic solvent used for comparison were Solv-2 and O-1.

0–1 (High boiling organic solvent for comparison):

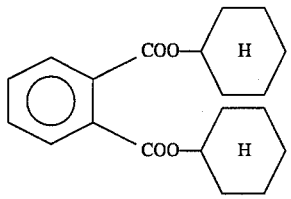

Dielectric Constant (25° C., 10 kHz) 6.45

[Evaluation of Samples]

The maximum density of the generated color ($D_{maxR}$) in each processed sample was measured with red rays of light. Further, the area providing the density of 1.0 when measured with red rays of light was examined for density by means of green rays of light. The thus obtained density was defined as $D_G$, and adopted as a criterion of cyan color reproduction. $D_G$ values indicate that the cyan colors reproduced are more satisfactory the smaller they are.

TABLE 2

| Sample | Coupler | High Boiling Organic Solvent | Ratio (by weight) of High Boiling Organic Solvent to coupler | $D_{maxR}$ | $D_G$ | Note |
|---|---|---|---|---|---|---|
| 9 | ExC | Solv-2 | 1.6:1 | 1.41 | 0.35 | Comparison |
| 10 | " | O-1 | 1.6:1 | 1.23 | 0.36 | " |
| 11 | " | P-10 | 0.5:1 | 1.41 | 0.32 | " |
| 12 | " | " | 1.1:1 | 1.30 | 0.32 | " |
| 13 | " | " | 5:1 | 1.07 | 0.32 | " |
| 14 | " | A-1 | 0.5:1 | 1.38 | 0.32 | " |
| 15 | " | " | 1.1:1 | 1.29 | 0.32 | " |
| 16 | " | " | 5:1 | 1.04 | 0.32 | " |
| 17 | " | A-20 | 1.6:1 | 1.26 | 0.32 | " |
| 18 | " | A-31 | " | 1.24 | 0.33 | " |
| 19 | " | A-38 | " | 1.25 | 0.33 | " |
| 20 | " | A-1:Solv-2 = 7:3 | " | 1.33 | 0.33 | " |
| 21 | C-21 | Solv-2 | 0.5:1 | 2.15 | 0.36 | " |
| 22 | " | " | 1.6:1 | 2.25 | 0.36 | " |
| 23 | " | " | 7:1 | 2.22 | 0.35 | " |
| 24 | " | O-1 | 1.6:1 | 2.05 | 0.37 | " |
| 25 | " | P-10 | 0.5:1 | 2.23 | 0.26 | Invention |
| 26 | " | " | 1.1:1 | 2.40 | 0.22 | " |
| 27 | " | " | 1.6:1 | 2.43 | 0.19 | " |
| 28 | " | " | 5:1 | 2.45 | 0.19 | " |
| 29 | " | " | 7:1 | 2.40 | 0.19 | " |
| 30 | " | " | 8:1 | 2.33 | 0.19 | " |
| 31 | " | A-1 | 0.5:1 | 2.20 | 0.25 | " |
| 32 | " | " | 1.1:1 | 2.88 | 0.21 | " |
| 33 | " | " | 1.6:1 | 2.41 | 0.19 | " |
| 34 | " | " | 5:1 | 2.43 | 0.19 | " |
| 35 | " | " | 7:1 | 2.36 | 0.19 | " |
| 36 | " | " | 8:1 | 2.28 | 0.19 | " |
| 37 | " | P-10:Solv-2 = 1:2 | 1.6:1 | 2.34 | 0.28 | " |
| 38 | " | P-10:Solv-2 = 1:1 | " | 2.36 | 0.26 | " |
| 39 | " | P-10:Solv-2 = 3:2 | " | 2.37 | 0.23 | " |
| 40 | " | P-10:Solv-2 = 7:3 | " | 2.40 | 0.21 | " |
| 41 | " | P-10:Solv-2 = 1:1 | 1.1:1 | 2.30 | 0.27 | " |
| 42 | " | P-10:Solv-2 = 1:1 | 3.1:1 | 2.38 | 0.24 | " |
| 43 | " | " | 5:1 | 2.40 | 0.24 | " |
| 44 | " | " | 7:1 | 2.28 | 0.24 | " |
| 45 | " | " | 8:1 | 2.26 | 0.24 | " |

TABLE 2-continued

| Sample | Coupler | High Boiling Organic Solvent | Ratio (by weight) of High Boiling Organic Solvent to coupler | $D_{maxR}$ | $D_G$ | Note |
|---|---|---|---|---|---|---|
| 46 | " | P-2 | 1.6:1 | 2.42 | 0.20 | " |
| 47 | " | A-5 | " | 2.40 | 0.20 | " |
| 48 | " | A-11 | " | 2.39 | 0.22 | " |
| 49 | " | A-8 | " | 2.44 | 0.25 | " |
| 50 | " | A-13 | " | 2.43 | 0.24 | " |
| 51 | " | A-20 | " | 2.32 | 0.19 | " |
| 52 | " | A-28 | " | 2.39 | 0.23 | " |
| 53 | " | A-31 | " | 2.31 | 0.22 | " |
| 54 | " | A-38 | " | 2.37 | 0.25 | " |
| 55 | " | A-39 | " | 2.31 | 0.21 | " |
| 56 | C-10 | Solv-2 | " | 2.27 | 0.34 | Comparison |
| 57 | " | P-10 | 0.5:1 | 2.19 | 0.25 | Invention |
| 58 | " | " | 1.6:1 | 2.42 | 0.19 | " |
| 59 | " | " | 7:1 | 2.40 | 0.19 | " |
| 60 | " | A-1 | 1.6:1 | 2.40 | 0.21 | " |
| 61 | " | A-20 | 1.6:1 | 2.39 | 0.19 | " |
| 62 | C-14 | Solv-2 | " | 2.25 | 0.35 | Comparison |
| 63 | " | P-10 | " | 2.44 | 0.19 | Invention |
| 64 | " | A-1 | 0.5:1 | 2.17 | 0.24 | " |
| 65 | " | " | 1.6:1 | 2.39 | 0.19 | " |
| 66 | " | " | 7:1 | 2.37 | 0.19 | " |
| 67 | " | A-13 | 1.6:1 | 2.42 | 0.23 | " |
| 68 | " | A-20 | " | 2.30 | 0.19 | " |
| 69 | C-12 | Solv-2 | " | 2.26 | 0.35 | Comparison |
| 70 | " | P-10 | " | 2.43 | 0.20 | Invention |
| 71 | " | A-1 | " | 2.38 | 0.21 | " |
| 72 | C-20 | Solv-2 | " | 2.27 | 0.34 | Comparison |
| 73 | " | P-10 | " | 2.44 | 0.19 | Invention |
| 74 | " | A-1 | " | 2.41 | 0.20 | " |
| 75 | C-44 | Solv-2 | " | 2.11 | 0.36 | Comparison |
| 76 | " | P-10 | " | 2.23 | 0.21 | Invention |
| 77 | " | A-1 | " | 2.22 | 0.22 | " |
| 78 | C-45 | Solv-2 | " | 2.08 | 0.36 | Comparison |
| 79 | " | P-10 | " | 2.19 | 0.22 | Invention |
| 80 | " | A-1 | " | 2.17 | 0.22 | " |
| 81 | C-43 | Solv-2 | " | 1.99 | 0.35 | Comparison |
| 82 | " | P-10 | " | 2.16 | 0.22 | Invention |
| 83 | " | A-1 | " | 2.14 | 0.23 | " |
| 84 | C-42 | Solv-2 | " | 1.89 | 0.35 | Comparison |
| 85 | " | P-10 | " | 2.09 | 0.25 | Invention |
| 86 | " | A-1 | " | 2.07 | 0.24 | " |
| 87 | C-41 | Solv-2 | " | 1.88 | 0.34 | Comparison |
| 88 | " | P-10 | " | 2.10 | 0.24 | Invention |
| 89 | " | A-1 | " | 2.07 | 0.24 | " |
| 90 | C-22 | Solv-2 | " | 1.84 | 0.36 | Comparison |
| 91 | " | P-10 | " | 1.99 | 0.28 | Invention |
| 92 | " | A-1 | " | 1.95 | 0.28 | " |
| 93 | C-23 | Solv-2 | " | 1.82 | 0.35 | Comparison |
| 94 | " | P-10 | " | 1.97 | 0.27 | Invention |
| 95 | " | A-1 | " | 1.96 | 0.28 | " |

The data shown in Table 2 bring out the following facts:

(i) As can be seen from the comparison between a group of Samples 1 and from 10 to 19 and a group of Samples 21 to 95, the dyes generated from the present couplers had color densities higher than those generated from the phenol type coupler by a factor of 1.3 to 1.6 when these couplers were used in combination with a high boiling organic solvent other than the present ones, such as Solv-2, whereas the former dyes had color densities higher than the latter dyes by a factor of 1.5 to 1.9 when the foregoing couplers were used in combination with the present high boiling organic solvents.

That is, it has turned out that the present combinations provide color generation performance better than expected.

(ii) With respect to color reproduction, the dyes generated in the cases the phenol type coupler for comparison was used in combination with Solv-2 (a high boiling organic solvent used for comparison) and 0–1 (a high boiling organic solvent other than the present ones) respectively and the dyes generated in the cases the present couplers were used in combination with Solv-2 or 0–1 respectively were all inferior in hue and had almost the same, considerably great $D_G$ values. That is, wholly satisfactory color reproduction was not accomplished even when the present couplers were used. Additionally, the hue was somewhat improved in the cases the present high boiling organic solvents were used in combination with the phenol type coupler for comparison, but the degree of improvement was by no means satisfactory. In contrast to the above-described cases, the present couplers were able to provide more improved hue when used in combination with the present high boiling organic solvents (Samples 25 to 55, 57to 61, 63 to 66, 70 to 71, 73 to 74, 76 to 77, 79 to 89, 82 to 83, 85 to 86, 88 to 89, 91 to 92, and 94 to 95).

Of the samples prepared in accordance with the present invention, the samples using the amide type high boiling organic solvents in which a hydrogen atom was contained as $R_9$ was able to achieve very excellent color reproduction, as can be seen by the comparison between a sample group including Samples 33, 47, 48 and 51 and another group including Samples 49 and 50. In particular, the samples using the amide type high boiling organic solvents in which $R_9$ was a hydrogen and at least one among $R_7$, $R_8$, $R_{10}$ and $R_{11}$ was a phenyl group enabled the achievement of especially excellent color reproduction, as can be seen by the comparison between Samples 33 and 47 and Sample 48.

(iii) With respect to the amount of the present high boiling organic solvent used, as can be seen by the comparison of Samples 25 to 30 and by the comparison of Samples 31 to 36, the greater the high boiling organic solvent/coupler ratio was, the smaller the $D_G$ value became, that is, the more satisfactory the color reproduction became. However, it has turned out that the lowering of the generated color density was caused when the high boiling organic solvent/coupler ratio was increased beyond 5 by weight. In addition, such an increase in the high boiling organic solvent/coupler ratio gave rise to an ill effect that the film surface of the resulting sample was liable to be scratched. In the cases the present high boiling organic solvents were used together with the other high boiling organic solvent, a smaller $D_G$ value, or more excellent color reproduction, was obtained the higher the proportion of the present high boiling organic solvent was (See Samples 37 to 40).

(iv) As can be seen by the comparison between a group of the samples using the couplers having general formula (Ib), including Samples 27, 58, 63 and 73, and a group of the samples using the present couplers other than those having general formula (Ib), including Samples 91 and 94, the dyes generated from the couplers having general formula (Ib) had the smallest $D_G$ value. That is, the couplers having general formula (Ib) have proved to be especially excellent in color reproduction.

EXAMPLE 3

[Preparation of Samples 96 to 137]

Samples 96 to 137 were prepared in the same manner as Sample 1 used in Example 1, except that the cyan coupler ExC and the high boiling organic solvent Solv-2 used in preparing the emulsified dispersion for the coating solution of the fifth layer were replaced so as to be shown in Table 3, and then subjected to the same exposure and photographic processing operations as in Example 1. Therein, the couplers and the high boiling organic solvents were used in the same amounts as in Example 1 respectively. In case of using 4-equivalent couplers, the coverage of the resulting emulsion was adjusted so that the content of silver halide in the emulsion layer might be twice that of Sample 1. Further, the average diameter of particles in each emulsified dispersion was adjusted to the value shown in Table 3 by controlling the agitation speed at the time of emulsifying dispersion. The diameters of particles were determined with Nonasizer produced by British Coulter Co. (an apparatus in which the particle diameter is measured using laser beam scattering).

[Evaluation of Samples]

Each of the processed samples was examined with red rays of light for the maximum density of generated color ($D_{maxR}$). Further, the density in the area having the density of 1.0 when measured with red rays of light was examined with blue rays of light, and designated as $D_B$ After the density measurements, each sample was allowed to stand for 3 days under the condition of 60° C. and 70% RH.

Then, the area which had undergone the density measurement before the standing was examined again with red rays of light and blue rays of light, and the ratio of the density measured with blue rays of light to the density measured with red rays of light, designated as $D_B'$, was determined. The difference between $D_B$ and $D_B'$, ($D_B$–$D_B'$), is defined as $\Delta D_B$ · $\Delta D_B$ is a measure of the increment of brown color mixing upon storage under the high temperature-high humidity condition, so that the value thereof means that the smaller it is, the less the brown color mixing is increased.

TABLE 3

| Sample | Coupler | High Boiling Organic Solvent[1)] | Average Diameter Of Particles (μm) | $D_{maxR}$ | $\Delta D_B$ | Note |
|---|---|---|---|---|---|---|
| 96 | ExC | Solv-2 | 0.62 | 1.41 | 0.19 | Comparison |
| 97 | " | " | 0.45 | 1.53 | 0.11 | " |
| 98 | " | " | 0.36 | 1.55 | 0.11 | " |
| 99 | " | " | 0.19 | 1.55 | 0.10 | " |
| 100 | " | " | 0.12 | 1.66 | 0.10 | " |
| 101 | " | " | 0.09 | 1.82 | 0.10 | " |
| 102 | " | " | 0.07 | 1.84 | 0.10 | " |
| 103 | " | P-10 | 0.65 | 1.39 | 0.12 | " |
| 104 | " | " | 0.43 | 1.39 | 0.12 | " |
| 105 | " | " | 0.38 | 1.41 | 0.12 | " |
| 106 | " | " | 0.18 | 1.42 | 0.12 | " |
| 107 | " | " | 0.13 | 1.52 | 0.11 | " |
| 108 | " | " | 0.09 | 1.66 | 0.11 | " |
| 109 | " | " | 0.06 | 1.69 | 0.11 | " |
| 110 | " | A-1 | 0.61 | 1.38 | 0.12 | " |
| 111 | " | " | 0.42 | 1.38 | 0.12 | " |
| 112 | " | " | 0.35 | 1.40 | 0.12 | " |
| 113 | " | " | 0.21 | 1.41 | 0.11 | " |
| 114 | " | " | 0.11 | 1.51 | 0.11 | " |
| 115 | " | " | 0.09 | 1.66 | 0.11 | " |
| 116 | " | " | 0.06 | 1.68 | 0.11 | " |
| 117 | C-21 | Solv-2 | 0.64 | 2.22 | 0.07 | " |
| 118 | " | " | 0.43 | 2.23 | 0.05 | " |
| 119 | " | " | 0.38 | 2.25 | 0.04 | " |
| 120 | " | " | 0.19 | 2.25 | 0.04 | " |

TABLE 3-continued

| Sample | Coupler | High Boiling Organic Solvent[1)] | Average Diameter Of Particles (μm) | $D_{maxR}$ | $\Delta D_B$ | Note |
|---|---|---|---|---|---|---|
| 121 | " | " | 0.11 | 2.20 | 0.03 | " |
| 122 | " | " | 0.09 | 2.18 | 0.03 | " |
| 123 | " | " | 0.07 | 2.05 | 0.03 | " |
| 124 | " | P-10 | 0.62 | 2.41 | 0.05 | Invention |
| 125 | " | " | 0.41 | 2.41 | 0.03 | " |
| 126 | " | " | 0.36 | 2.42 | 0.02 | " |
| 127 | " | " | 0.18 | 2.42 | 0.01 | " |
| 128 | " | " | 0.12 | 2.40 | 0.01 | " |
| 129 | " | " | 0.09 | 2.35 | 0.01 | " |
| 130 | " | " | 0.07 | 2.24 | 0.01 | " |
| 131 | " | A-1 | 0.63 | 2.39 | 0.01 | " |
| 132 | " | " | 0.41 | 2.39 | 0.01 | " |
| 133 | " | " | 0.37 | 2.41 | 0.01 | " |
| 134 | " | " | 0.20 | 2.41 | 0.01 | " |
| 135 | " | " | 0.13 | 2.37 | 0.01 | " |
| 136 | " | " | 0.09 | 2.32 | 0.01 | " |
| 137 | " | " | 0.06 | 2.22 | 0.01 | " |

[1)]Ratio (by weight) of High Boiling Organic Solvent to Coupler = 1:1.6

The data of Table 3 clearly show that the colors generated from the present couplers had much higher densities than the phenol type coupler, regardless of whether the diameter of the coupler-containing oleophilic fine particles was great or small. However, it has been found that a drop in the generated color density was caused in the case the present coupler-containing oleophilic fine particles had a diameter smaller than 0.08 μm, as can be seen by the comparison between Samples 124 to 129 and Sample 130, the comparison between Samples 131 to 136 and Sample 137, and so on. Thus, the oleophilic fine particles having a diameter of no smaller than 0.08 μm have proved preferable.

Further, making a comparison between each pair of samples whose emulsified dispersions had diameters equivalent to each other, which were chosen from a group of Samples 96 to 123 for comparison and a group of Samples 124 to 137 according to the present invention respectively, it has turned out that the present samples were reduced in the increment of brown color mixing due to the increase in absorption of blue rays of light upon storage under the condition of high temperature and high humidity, compared with not only the samples for comparison in which the phenol type coupler was used as the coupler for comparison but also the samples for comparison in which the present couplers were used in combination with the high boiling organic solvent for comparison. Furthermore, making a comparison between Sample 124 and Samples 125 to 130, it has been found that the present samples showed a very slight increase in absorption of blue rays of light, that is, had a very small increment of the brown color mixing upon storage under the condition of high temperature and high humidity, when the particles of their respective emulsified dispersions had a diameter smaller than 0.5 μ m.

Thus, it has proved that the present invention can provide a higher density of generated color and can reduce the generation of brown color mixing upon storage under a high temperature-high humidity condition, that is, can achieve a more desirable result, by adjusting the size of the present coupler-containing oleophilic particles to the range of 0.08 to 0.5μm.

In accordance with the present invention, therefore, there can be obtained color photographs having a high efficiency of cyan color generation and satisfactory color reproduction resulting from excellent spectral sensitivity characteristics of the present cyan dyes. In addition, the colors generated in the photographs are little rendered muddy even by storage under a high temperature-high humidity condition, namely the color photographs obtained have excellent image storage characteristics.

What is claimed is:

1. A silver halide color photosensitive material comprising a support, a cyan dye-forming coupler containing silver halide emulsion layer, a magenta dye-forming coupler containing silver halide emulsion layer, and a yellow dye-forming coupler containing silver halide emulsion layer, wherein said cyan dye-forming coupler containing silver halide emulsion layer comprises a dispersion containing at least one cyan dye-forming coupler represented by the following general formula (Ib) and at least one high boiling organic solvent represented by the following general formula (II) or (III):

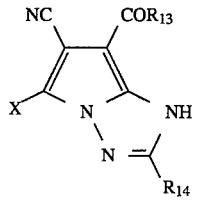

(Ib)

wherein $R_{13}$ represents a straight-chain, branched or cyclic alkyl group, a straight-chain, branched or cyclic alkoxy group, an aryl group, an aryloxy group, a heterocyclyl group, an alkylamino group, an anilino group, a heterocyclyloxy group or a heterocyclylamino group; $R_{14}$ is selected from the group consisting of a hydrogen atom, a halogen atom, an aliphatic group, an aryl group, a heterocyclyl group, an alkoxy group, an aryloxy group, a heterocyclyloxy group, an alkyl-, aryl- or heterocyclylthio group, an acyloxy group, a carbamoyloxy group, an silyloxy group, an sulfonyloxy group, an acylamino group, an alkylamino group, an arylamino group, an ureido group, a sulfamoylamino group, an alkenyloxy group, a formyl group, an alkyl-, aryl- or heterocycylacyl group, an alkyl-, aryl- or heterocyclylsulfonyl group, an alkyl-, aryl- or heterocyclylsulfinyl an alkyl-, aryl- or heterocyclyloxycarbonyl group, an alkyl-, aryl- or heterocyclyloxycarbonylamino group, a sulfonamido group, a carbamoyl group, a sulfamoyl group, a phosphonyl group, a sulfamido group, an imido group, an azolyl group, a hydroxy group, a cyano group, a carboxyl group, a nitro group, a sulfo group, and an unsubstituted amino group, and said alkyl, aryl or heterocyclyl moieties contained in the above-cited groups are optionally substituted with any of said above-cited groups; X represents a hydrogen atom or a group capable of splitting off by the coupling reaction with the oxidation product of an aromatic primary amine color developing agent; further, $R_{13}$, $R_{14}$ and X each may represent a divalent group via which a dimer or higher polymer may be formed or to which a high molecular chain is bonded to form a homo- or copolymer;

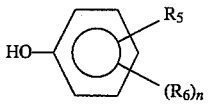

(II)

wherein $R_5$ and $R_6$ each represent an alkyl group, a cycloalkyl group, an alkoxy group or a halogen atom; n represents an integer of 0 to 4, and $R_6$'s are the same or different when n is not smaller than 2; and further, $R_5$ and R6 may combine with each other to complete a 5- or 6-membered ring;

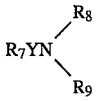

(III)

wherein $R_7$, $R_8$ and $R_9$ each represent a hydrogen atom, an alkyl group, a cycloalkyl group, an alkenyl group, a cycloalkenyl group, an alkinyl group, an aryl group, a heterocyclyl group, an alkoxy group, an aryloxy group or a heterocyclyloxy group, or $R_7$ represents —$NR_{10}$ $R_{11}$ wherein $R_{10}$ and $R_{11}$ each represent a hydrogen atom, an alkyl group, a cycloalkyl group, an alkenyl group, a cycloalkenyl group, an alkinyl group, an aryl group, a heterocyclyl group, an alkoxy group, an aryloxy group or a heterocyclyloxy group; and further, a ring may be formed by combining $R_7$ with $R_8$, $R_8$ with $R_9$, or $R_9$ with $R_{10}$; and Y represents a carbonyl group, a sulfonyl group or —$(R_{12})P(O)$— wherein $R_{12}$ represents a hydrogen atom, an alkyl group, a cycloalkyl group, an alkenyl group, a cycloalkenyl group, an alkinyl group, an aryl group, a heterocyclyl group, an alkoxy group, an aryloxy group or a heterocyclyloxy group;

said dispersion containing at least one cyan dye-forming coupler represented by formula (Ib) and at least one high boiling organic solvent represented by formula (II) or (III) having a diameter of 0.08 to 0.5 μm.

2. The silver halide color photosensitive material of claim 1, wherein the ratio of the high boiling organic solvent of general formula (II) or (III) to the cyan dye-forming coupler of general formula (Ib) is not less than 0.5 by weight.

3. The silver halide color photosensitive material of claim 2, wherein the ratio of the high boiling organic solvent of general formula (II) or (III) to the cyan dye-forming coupler of general formula (Ib) ranges from 1.1 to 7 by weight.

4. The silver halide color photosensitive material of claim 3, wherein the ratio of the high boiling organic solvent of general formula (II) or (III) to the cyan dye-forming coupler of general formula (Ib) ranges from 1.6 to 5 by weight.

5. The silver halide color photosensitive material of claim 1, wherein the content of the cyan dye-forming coupler of general formula (Ib) in the silver halide emulsion layer ranges from 0.01 to 1 mole per mole of silver halide.

6. The silver halide color photosensitive material of claim 1, wherein the high boiling organic solvent of general formula (II) or (III) comprises at least 50 mole % of the whole high boiling organic solvents incorporated in the dispersion.

7. The silver halide color photosensitive material of claim 6, wherein the ratio of the whole high boiling organic solvents to the cyan dye-forming coupler of general formula (Ib) ranges from 1.1 to 8 by weight.

8. The silver halide color photosensitive material of claim 1, wherein $R_{13}$ represents an unsubstituted branched alkoxy group containing 4 to 18 carbon atoms, a cycloalkoxy group, an alkoxy group substituted with an electron-withdrawing group selected from the group consisting of an alkoxycarbonyl group, an acyl group, a nitro group, a cyano group and a sulfonyl group.

9. The silver halide color photosensitive material of claim 1, wherein the cyan dye-forming coupler of general formula (Ib) contains as X a halogen atom, an alkoxy group, an aryloxy group, an alkylthio group, an arylthio group, an arylsulfonyl group, an arylsulfinyl group, or a nitrogen-containing 5- or 6-membered heterocyclyl group which is attached to the coupling active site via a nitrogen thereof.

10. The silver halide color photosensitive material of claim 1, wherein the high boiling organic solvent of general formula (III) contains a carbonyl group or a sulfonyl group as Y.

11. The silver halide color photosensitive material of claim 1, wherein the high boiling organic solvent of general formula (III) contains a hydrogen atom as $R_9$.

12. The silver halide color photosensitive material of claim 11, wherein $R_7$, $R_8$, $R_{10}$ and $R_{11}$ in general formula (III) each represent an alkyl or aryl group.

13. The silver halide color photosensitive material of claim 12, wherein $R_7$, $R_8$, $R_{10}$ and $R_{11}$ each represent an aryl group.

14. The silver halide color photosensitive material of claim 1, wherein said cyan dye-forming coupler containing silver halide emulsion layer contains silver halide emulsion grains comprising silver chlorobromide having a silver chloride content of 90 mol % or more, and being substantially free from silver iodide.

15. The silver halide color photosensitive material of claim 1, wherein $R_{14}$ is a substituted or unsubstituted alkyl group or a substituted or unsubstituted aryl group, and when $R_{14}$ is the substituted alkyl group or the substituted aryl group, said substituted alkyl group or substituted aryl group is substituted with alkoxy, sulfonyl, sulfamoyl, carbamoyl, acylamido or sulfonamido.

16. The silver halide color photosensitive material of claim 1, wherein the cyan couplers represented by general formula (Ib) are present in a silver halide emulsion layer in an amount from 0.01 to 1 mole per mole of silver.

17. The silver halide color photosensitive material of claim 1, wherein when the high boiling organic solvents are used individually, the amount thereof is from 50 to 800 parts by weight per 100 parts by weight of the cyan coupler.

18. The silver halide color photosensitive material of claim 1, wherein the dispersion is comprised of the cyan dye-forming coupler of general formula (Ib) and the high boiling organic solvent of general formula (II) or (III), said dispersion having a diameter of 0.1 to 0.4 μm.

19. A silver halide color photosensitive material comprising a support, a cyan dye-forming coupler containing silver halide emulsion layer, a magenta dye-forming coupler containing silver halide emulsion layer, and a yellow dye-forming coupler containing silver halide emulsion layer, wherein said cyan dye-forming coupler containing silver halide emulsion layer comprises a dispersion containing at least one cyan dye-forming coupler represented by the following general formula (Ib) and at least one high boiling organic solvent represented by the following general formula (II) or (III):

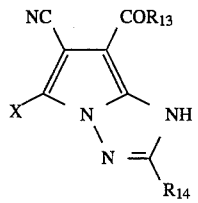

(Ib)

wherein $R_{13}$ represents a straight-chain, branched or cyclic alkyl group, a straight-chain, branched or cyclic alkoxy group, an aryl group, an aryloxy group, a heterocyclyl group, an alkylamino group, an anilino group, a heterocyclyloxy group or a heterocyclylamino group; $R_{14}$ represents an alkyl group, an aryl group, an heterocyclyl group, a cyano group, a nitro group, an acylamino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclyloxy group, an acyloxy group, a carbamoyloxy group, an aryloxycarbonylamino group, an imido group, a heterocyclylthio group, a sulfinyl group, a phosphonyl group, an acyl group or an azolyl group; X represents a hydrogen atom or a group capable of splitting off by the coupling reaction with the oxidation product of an aromatic primary amine color developing agent; further, $R_{13}$, $R_{14}$ and X each may represent a divalent group via which a dimer or higher polymer may be formed or to which a high molecular chain is bonded to form a homo- or copolymer;

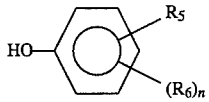

(II)

wherein $R_5$ and $R_6$ each represent an alkyl group, a cycloalkyl group, an alkoxy group or a halogen atom; n represents an integer of 0 to 4, and $R_6$'s are the same or different when n is not smaller than 2; and further, $R_5$ and $R_6$ may combine with each other to complete a 5- or 6-membered ring;

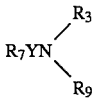

(III)

wherein $R_7$, $R_8$ and $R_9$ each represent a hydrogen atom, an alkyl group, a cycloalkyl group, an alkenyl group, a cycloalkenyl group, an alkinyl group, an aryl group, a heterocyclyl group, an alkoxy group, an aryloxy group or a heterocyclyloxy group, or $R_7$ represents $—NR_{10}R_{11}$ wherein $R_{10}$ and $R_{11}$ each represent a hydrogen atom, an alkyl group, a cycloalkyl group, an alkenyl group, a cycloalkenyl group, an alkinyl group, an aryl group, a heterocyclyl group, an alkoxy group, an aryloxy group or a heterocyclyloxy group; and further, a ring may be formed by combining $R_7$ with $R_8$, $R_8$ with $R_9$, or $R_9$ with $R_{10}$; and Y represents a carbonyl group, a sulfonyl group or $—(R_{12})P(O)—$ wherein $R_{12}$ represents a hydrogen atom, an alkyl group, a cycloalkyl group, an alkenyl group, a cycloalkenyl group, an alkinyl group, an aryl group, a heterocyclyl group, an alkoxy group, an aryloxy group or a heterocyclyloxy group;

said dispersion containing at least one cyan dye-forming coupler represented by formula (Ib) and at least one high boiling organic solvent represented by formula (II) or (III) having a diameter of 0.08 to 0.5 μm.

* * * * *